US008256008B2

(12) United States Patent
Hayano

(10) Patent No.: US 8,256,008 B2
(45) Date of Patent: Aug. 28, 2012

(54) METHOD, APPARATUS, AND SYSTEM FOR OUTPUTTING INFORMATION AND FORMING IMAGE VIA NETWORK, AND COMPUTER PRODUCT

(75) Inventor: Atsuko Hayano, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 800 days.

(21) Appl. No.: 12/112,072

(22) Filed: Apr. 30, 2008

(65) Prior Publication Data

US 2008/0209531 A1 Aug. 28, 2008

Related U.S. Application Data

(62) Division of application No. 10/846,628, filed on May 17, 2004, now Pat. No. 7,516,494.

(30) Foreign Application Priority Data

May 16, 2003 (JP) ..... 2003-139161

(51) Int. Cl.
*H04L 29/06* (2006.01)

(52) U.S. Cl. ..... 726/26; 713/1; 713/167; 713/193

(58) Field of Classification Search ..... 713/157
See application file for complete search history.

(56) References Cited

U.S. PATENT DOCUMENTS 5,126,732 A * 6/1992 Mardon ..... 340/5.33
5,270,773 A * 12/1993 Sklut et al. ..... 399/20
5,358,238 A * 10/1994 Mandel et al. ..... 271/298
5,464,200 A * 11/1995 Nakazato et al. ..... 270/52.02
5,493,408 A * 2/1996 Kurogane et al. ..... 358/296
5,525,031 A * 6/1996 Fox ..... 414/789.7
5,610,724 A * 3/1997 Kaneko et al. ..... 358/400
5,673,373 A * 9/1997 Nosaki et al. ..... 358/1.15
5,845,057 A * 12/1998 Takeda et al. ..... 358/1.15
5,982,994 A * 11/1999 Mori et al. ..... 358/1.15
6,014,228 A * 1/2000 Castro ..... 358/400
RE37,031 E 1/2001 Nishiwaki
(Continued)

FOREIGN PATENT DOCUMENTS

EP 0 622 695 A1 11/1994
(Continued)

OTHER PUBLICATIONS

Flynn et al., The Satchel system architecture: mobile access to documents and services, Dec. 2000, Mobile Networks and Applications, vol. 5 Issue 4, pp. 243-258.*

*Primary Examiner* — Taghi Arani
*Assistant Examiner* — Kenneth Chang
(74) *Attorney, Agent, or Firm* — Oblon, Spivak, McClelland, Maier & Neustadt, L.L.P.

(57) ABSTRACT

An information output apparatus includes a tray determining unit that determines an output tray to which printed sheets are output, a secret information generating unit that generates first secret information corresponding to tray identification information for identifying the output tray determined, a transmitting unit that transmits the first secret information generated by the secret information generating unit to a terminal, an input accepting unit that accepts an input of second secret information from a user, and a tray controlling unit that specifies the output tray based on the first secret information when the second secret information and the first secret information coincide with each other, and allows a slot of the specified tray to be open.

45 Claims, 14 Drawing Sheets

U.S. PATENT DOCUMENTS

| | | | | |
|---|---|---|---|---|
| 6,421,582 | B1 * | 7/2002 | Wada | 700/232 |
| 2002/0021902 | A1 * | 2/2002 | Hosoda et al. | 396/429 |
| 2003/0133150 | A1 * | 7/2003 | Tamai et al. | 358/1.15 |

FOREIGN PATENT DOCUMENTS

| | | |
|---|---|---|
| JP | 6-187109 | 7/1994 |
| JP | 7-97125 | 4/1995 |
| JP | 7-195798 | 8/1995 |
| JP | 8-2782 | 1/1996 |
| JP | 8-198500 | 8/1996 |
| JP | 11/28850 | 2/1999 |
| JP | 2001-265739 | 9/2001 |
| JP | 2001-322337 | 11/2001 |

* cited by examiner

FIG.2

134

| OUTPUT TRAY | PRINT DATA | SECRET CODE |
|---|---|---|
| TRAY1 | abc | 12459 |
| TRAY2 | XYZ | 57873 |
| TRAY3 | LMN | 25459 |

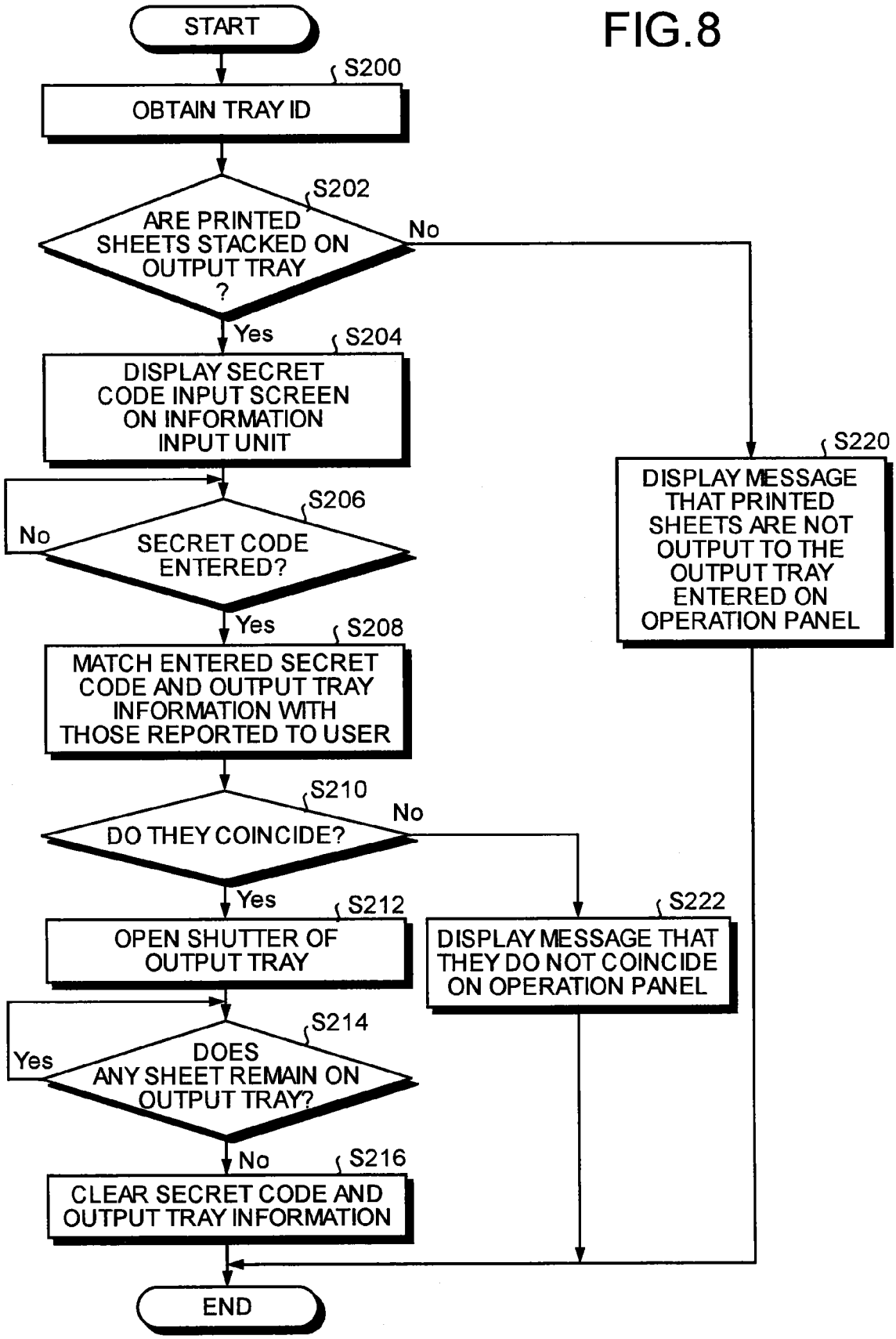
FIG.8
START
S200
OBTAIN TRAY ID
S202
ARE PRINTED SHEETS STACKED ON OUTPUT TRAY ?
No
Yes
S204
DISPLAY SECRET CODE INPUT SCREEN ON INFORMATION INPUT UNIT
S206
SECRET CODE ENTERED?
No
Yes
S208
MATCH ENTERED SECRET CODE AND OUTPUT TRAY INFORMATION WITH THOSE REPORTED TO USER
S210
DO THEY COINCIDE?
No
Yes
S212
OPEN SHUTTER OF OUTPUT TRAY
S214
DOES ANY SHEET REMAIN ON OUTPUT TRAY?
Yes
No
S216
CLEAR SECRET CODE AND OUTPUT TRAY INFORMATION
S220
DISPLAY MESSAGE THAT PRINTED SHEETS ARE NOT OUTPUT TO THE OUTPUT TRAY ENTERED ON OPERATION PANEL
S222
DISPLAY MESSAGE THAT THEY DO NOT COINCIDE ON OPERATION PANEL
END

METHOD, APPARATUS, AND SYSTEM FOR OUTPUTTING INFORMATION AND FORMING IMAGE VIA NETWORK, AND COMPUTER PRODUCT

CROSS-REFERENCE TO RELATED APPLICATIONS

The present application is a divisional of U.S. patent application Ser. No. 10/846,628 filed on May 17, 2004 now U.S. Pat. No. 7,516,494, and incorporates by reference the entire contents of Japanese priority document, Japanese Patent Application No. 2003-139161 filed on May 16, 2003.

BACKGROUND OF THE INVENTION

1) Field of the Invention

The present invention relates to a technology for outputting information and forming an image via network.

2) Description of the Related Art

With a recent spread of the local area network (LAN), it is now a common practice that a single image forming apparatus and a plurality of terminals are connected to a network so that the terminals share the single image forming apparatus. Typical examples of such image forming apparatus are a printer and a multifunction product (MFP) in which various functions, such as a printer, a photocopier, a facsimile, and a scanner, are incorporated.

Furthermore, an image forming apparatus with a mechanism for outputting printed sheets to a plurality of sorters is currently in use. With such image forming apparatus, even when a single image forming apparatus is shared by a plurality of users, each user can easily identify and obtain his or her printed sheets. However, when a plurality of users share a single image forming apparatus, contents of the printed sheets are easily seen by others, and it is difficult to manage confidential documents.

To cope with the problem, a technology is disclosed in, for example, Japanese Patent Laid-Open Publication No. 2001-322337, that enables printing to be started only when a correct secret code preset to a user is entered into the image forming apparatus.

Another method employs a fingerprint by which only a print user authenticated by the fingerprint is allowed to use a network device (see, for example, Japanese Patent Laid-Open No. 2001-265739). According to this method, no person other than the print user can take out the printed sheets, thereby ensuring the confidentiality of the documents.

However, in the verification method using a secret code, once the secret code is entered, the printed sheets are delivered to an output tray, and the printed sheets are left in a situation that anyone can see the contents of the documents. Therefore, the user has to monitor the output tray from the beginning to the end of printing, causing a problem of binding the user during the printing process. Moreover, the user has to transmit the secret code with print data at each printing process, which can make a printing operation cumbersome.

On the other hand, in the method of fingerprint verification, the confidentiality of the documents is ensured because no person other than the print user can take out the printed sheets. However, it is not flexible to allow only the print user to use, which may cause inefficient usability.

Therefore, it is desired to develop a flexible technology for forming an image without binding the user while ensuring the confidentiality of documents.

SUMMARY OF THE INVENTION

It is an object of the present invention to solve at least the problems in the conventional technology.

The information output apparatus that processes data obtained from a terminal via a network and outputs the data processed, according to one aspect of the present invention, includes a data obtaining unit that obtains the data; a data processing unit that processes the data obtained; a plurality of storage units that store the data processed; a storage determining unit that determines the storage unit for the data processed from among the storage units; an output unit that outputs the data stored; a secret information generating unit that generates first secret information corresponding to storage unit identification information for identifying the storage unit determined; a transmitting unit that transmits the first secret information to the terminal; an input accepting unit that accepts an input of second secret information from a user; a matching unit that matches the second secret information with the first secret information; and an output control unit that specifies, upon the matching unit successfully matching the second secret information with the first secret information, the storage unit based on the first secret information, and allows an output from the storage unit specified to the output unit.

The information output system according to another aspect of the present invention includes an information output apparatus that obtains and processes data, and stores and outputs the data processed; and a terminal that transmits the data to the information output apparatus. The information output apparatus includes a data obtaining unit that obtains the data; a data processing unit that processes the data obtained; a plurality of storage units that store the data processed; a storage determining unit that determines the storage unit for the data processed from among the storage units; an output unit that outputs the data stored; and a first transmitting unit that transmits storage unit identification information for identifying the storage unit determined to the terminal. The terminal includes a first receiving unit that receives the storage unit identification information from the information output apparatus; a secret information generating unit that generates first secret information corresponding to the storage unit identification information received; and a second transmitting unit that transmits the first secret information to the information output apparatus. The information output apparatus further includes a second receiving unit that receives the first secret information from the terminal; an input accepting unit that accepts an input of second secret information from a user; a matching unit that matches the second secret information with the first secret information; and an output control unit that specifies, upon the matching unit successfully matching the second secret information with the first secret information, the storage unit based on the first secret information, and allows an output from the storage unit specified to the output unit.

The information output apparatus that processes data obtained from a terminal via a network and outputs the data processed, according to still another aspect of the present invention, includes a data obtaining unit that obtains the data; a data processing unit that processes the data obtained; a plurality of storage units that store the data processed; a storage determining unit that determines the storage unit for the data processed from among the storage units; an output unit that outputs the data stored; a transmitting unit that transmits storage unit identification information for identifying the storage unit determined to the terminal; a receiving unit that receives first secret information generated by the terminal as a response to the storage unit identification information transmitted, the first secret information corresponding to the storage unit identification information; an input accepting unit that accepts an input of second secret information from a user; a matching unit that matches the second secret information with the first secret information; and an output control unit that specifies, upon the matching unit successfully matching the second secret information with the first secret information, the storage unit based on the first secret information, and allows an output from the storage unit specified to the output unit.

The image forming apparatus having a plurality of output trays for stacking sheets on which print data obtained from a terminal via a network is printed, according to still another aspect of the present invention, includes a print data obtaining unit that obtains the print data; a printing unit that prints the print data obtained on a sheet; a tray determining unit that determines an output tray for the sheet on which the print data is printed from among the output trays; a secret information generating unit that generates first secret information corresponding to tray identification information for identifying the output tray determined; a transmitting unit that transmits the first secret information to the terminal; an input accepting unit that accepts an input of second secret information from a user; a matching unit that matches the second secret information with the first secret information; and a tray control unit that specifies, upon the matching unit successfully matching the second secret information with the first secret information, the output tray based on the first secret information, and allows a slot of the output tray specified to be open.

The image forming system according to still another aspect of the present invention includes an image forming apparatus having a plurality of output trays for stacking sheets on which print data is printed; and a terminal that transmits the print data to the image forming apparatus. The image forming apparatus includes a print data obtaining unit that obtains the print data; a printing unit that prints the print data obtained on a sheet; a tray determining unit that determines an output tray for the sheet on which the print data is printed from among the output trays; and a first transmitting unit that transmits tray identification information for identifying the output tray determined to the terminal, the terminal includes a first receiving unit that receives the tray identification information from the image forming apparatus; a secret information generating unit that generates first secret information corresponding to the tray identification information received; and a second transmitting unit that transmits the first secret information to the image forming apparatus. The image forming apparatus further includes a second receiving unit that receives the first secret information from the terminal; an input accepting unit that accepts an input of second secret information from a user; a matching unit that matches the second secret information with the first secret information; and a tray control unit that specifies, upon the matching unit successfully matching the second secret information with the first secret information, the output tray based on the first secret information, and allows a slot of the output tray specified to be open.

The image forming apparatus having a plurality of output trays for stacking sheets on which print data obtained from a terminal via a network is printed, according to still another aspect of the present invention, includes a print data obtaining unit that obtains the print data; a printing unit that prints the print data obtained on a sheet; a tray determining unit that determines an output tray for the sheet on which the print data is printed from among the output trays; a transmitting unit that transmits tray identification information for identifying the output tray determined; a receiving unit that receives first secret information generated by the terminal as a response to the tray identification information transmitted, the first secret information corresponding to the tray identification information; an input accepting unit that accepts an input of second secret information from a user; a matching unit that matches the second secret information with the first secret information; and a tray control unit that specifies, upon the matching unit successfully matching the second secret information with the first secret information, the output tray based on the first secret information, and allows a slot of the output tray specified to be open.

The information output method for processing data obtained from a terminal via a network and outputting the data processed, according to still another aspect of the present invention, includes steps of obtaining unit the data; processing the data obtained; storing the data processed in a storage unit; determining the storage unit for the data processed from among a plurality of storage units; outputting the data stored; generating first secret information corresponding to storage unit identification information for identifying the storage unit determined; transmitting the first secret information to the terminal; accepting an input of second secret information from a user; matching the second secret information with the first secret information; specifying, upon the matching successfully matching the second secret information with the first secret information, the storage unit based on the first secret information; and allowing an output from the storage unit specified at the outputting.

The information output method for an information output apparatus that obtains and processes data, and stores and outputs the data processed, and a terminal that transmits the data to the information output apparatus, according to still another aspect of the present invention, includes steps in the information output apparatus including obtaining the data; processing the data obtained; storing the data processed in a storage unit; determining the storage unit for the data processed from among a plurality of storage units; outputting the data stored; and transmitting storage unit identification information for identifying the storage unit determined to the terminal; steps in the terminal including receiving the storage unit identification information from the information output apparatus; generating first secret information corresponding to the storage unit identification information received; and transmitting the first secret information to the information output apparatus; and steps in the information output apparatus further including receiving the first secret information from the terminal; accepting an input of second secret information from a user; matching the second secret information with the first secret information; specifying, upon the matching successfully matching the second secret information with the first secret information, the storage unit based on the first secret information; and allowing an output from the storage unit specified at the outputting.

The information output method for processing data obtained from a terminal via a network and outputting the data processed, according to still another aspect of the present invention, includes obtaining the data; processing the data obtained; storing the data processed in a storage unit; determining the storage unit for the data processed from among a plurality of storage units; outputting the data stored;

transmitting storage unit identification information for identifying the storage unit determined to the terminal; receiving first secret information generated by the terminal as a response to the storage unit identification information transmitted, the first secret information corresponding to the storage unit identification information; accepting an input of second secret information from a user; matching the second secret information with the first secret information; specifying, upon the matching successfully matching the second secret information with the first secret information, the storage unit based on the first secret information; and allowing an output from the storage unit specified at the outputting.

The image forming method for an image forming apparatus having a plurality of output trays for stacking sheets on which print data obtained from a terminal via a network is printed, according to still another aspect of the present invention, includes obtaining the print data; printing the print data obtained on a sheet; determining an output tray for the sheet on which the print data is printed from among the output trays; generating first secret information corresponding to tray identification information for identifying the output tray determined; transmitting the first secret information to the terminal; accepting an input of second secret information from a user; matching the second secret information with the first secret information; specifying, upon the matching unit successfully matching the second secret information with the first secret information, the output tray based on the first secret information; and allowing a slot of the output tray specified to be open.

The image forming method for an image forming system including an image forming apparatus having a plurality of output trays for stacking sheets on which print data is printed and a terminal that transmits the print data to the image forming apparatus, according to still another aspect of the present invention, includes steps in the image forming apparatus including obtaining the print data; printing the print data obtained on a sheet; determining an output tray for the sheet on which the print data is printed from among the output trays; and transmitting tray identification information for identifying the output tray determined to the terminal; steps in the terminal including receiving the tray identification information from the image forming apparatus; generating first secret information corresponding to the tray identification information received; and transmitting the first secret information to the image forming apparatus; and steps in the image forming apparatus further including receiving the first secret information from the terminal; accepting an input of second secret information from a user; matching the second secret information with the first secret information; specifying, upon the matching successfully matching the second secret information with the first secret information, the output tray based on the first secret information; and allowing a slot of the output tray specified to be open.

The image forming method for an image forming apparatus having a plurality of output trays for stacking sheets on which print data obtained from a terminal via a network is printed, according to still another aspect of the present invention, includes obtaining the print data; printing the print data obtained on a sheet; determining an output tray for the sheet on which the print data is printed from among the output trays; transmitting tray identification information for identifying the output tray determined; receiving first secret information generated by the terminal as a response to the tray identification information transmitted, the first secret information corresponding to the tray identification information; accepting an input of second secret information from a user; matching the second secret information with the first secret information; specifying, upon the matching successfully matching the second secret information with the first secret information, the output tray based on the first secret information; and allowing a slot of the output tray specified to be open.

The information output program for processing data obtained from a terminal via a network and outputting the data processed, according to still another aspect of the present invention, realizes the methods according to the above aspects on a computer The computer readable recording medium according to still another aspect of the present invention stores the computer programs according to the above aspect.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 2 is a table of a data structure of a secret code relational table 134 shown in FIG. 1;

FIG. 8 is a flowchart of a process procedure for releasing a tray of the printer 10;

DETAILED DESCRIPTION

Exemplary embodiments of a network-connected information output apparatus, a network-connected information output system, a network-connected image forming apparatus, a network-connected image forming system, a method of outputting information via network, a method of outputting information in the network-connected information output system, an image forming method in network-connected image forming apparatus, an image forming method in the network-connected image forming system, and computer programs according to the present invention will be described in detail with reference to the accompanying drawings. The present invention relates to a technology of managing outputs of information in a network-connected information output apparatus. As one example of the information output apparatus, an image forming apparatus is taken for description below. However, the information output apparatus of the present invention is not restricted only to the image forming apparatus. That is, applicable as the information output apparatus are a printing apparatus, a facsimile apparatus, a video display apparatus, a sound output apparatus, a projector, a liquid crystal display apparatus, and a combination thereof.

Figure 1:
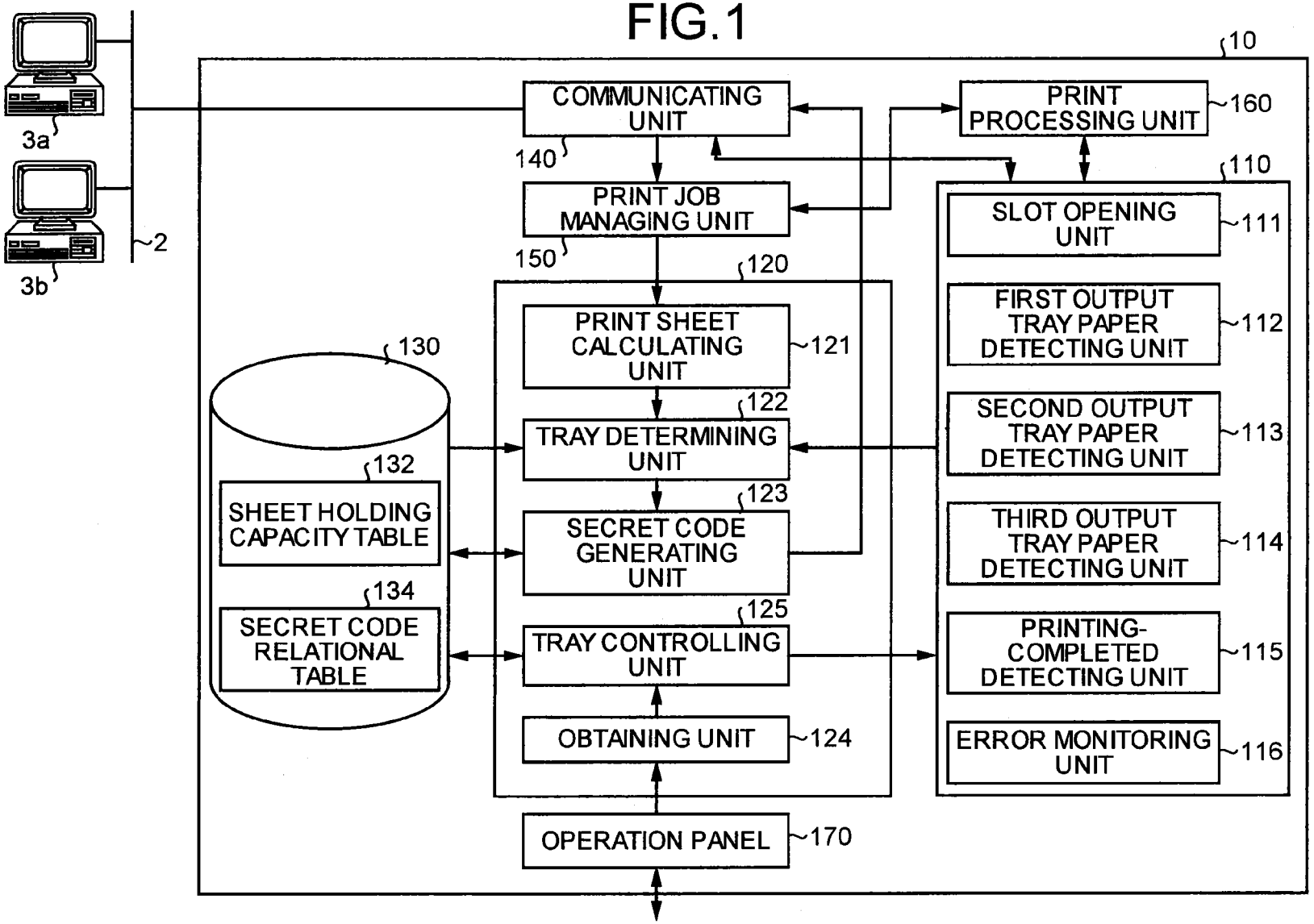
FIG. 1 is a schematic of an image forming system 1 according to a first embodiment of the present invention.

FIG. 1 is a schematic of an image forming system 1 according to a first embodiment of the present invention. The image forming system 1 includes a printer 10, which is one example of an image forming apparatus, and personal computers (PCs) 3, that is, 3*a* and 3*b*, which are examples of terminals. The printer 10 and the PC 3*a* and 3*b* are physically connected to one another via a communication cable 2. The printer 10 receives print data and a print instruction from the PC 3*a* and 3*b* via the communication cable 2. According to the print instruction, the received print data is printed on paper. In the present embodiment, the image forming system 1 forms a local area network (LAN). Alternatively, the printer 10 and the PCs 3 may perform transmission and reception of information via a network, such as the Internet.

The printer 10 includes an output tray unit 110 that controls output trays, a tray managing unit 120 that manages the output tray unit 110, a hard disk 130 that stores data to be used by the tray managing unit 120, a communicating unit 140 that communicates with the PCs 3 via the LAN, a print job managing unit 150 that manages jobs regarding print data, a print processing unit 160 that prints print data on paper, and an operation panel 170 as a user interface.

The output tray unit 110 includes a slot opening unit 111, a first output tray paper detecting unit 112, a second output tray paper detecting unit 113, a third output tray paper detecting unit 114, a printing-completed detecting unit 115, and an error monitoring unit 116.

The printer 10 according to the present invention includes three output trays, that is, a first output tray, a second output tray, and a third output tray. The first output tray paper detecting unit 112, the second output tray paper detecting unit 113, and the third output tray paper detecting unit 114 detect the presence or absence of sheets of paper stacked on the respective trays.

Specifically, the first output tray paper detecting unit 112, the second output tray paper detecting unit 113, and the third output tray paper detecting unit 114 are reflective photosensors.

The slot opening unit 111 opens a slot provided to each output tray. In the present embodiment, each output tray is provided with a slot from which the user can take out printed sheets of paper stacked on the relevant output tray. Each slot is provided with a shutter that can be opened or closed. On reception from the tray managing unit 120 of an opening instruction that allows the shutter to be open, the slot opening unit 111 opens the shutter of the slot. Note that the shutter of the slot is closed in a normal state.

The printing-completed detecting unit 115 detects that all pieces of print data have been printed out on sheets of paper and then the printed sheets have been output to one or more output trays. The error monitoring unit 116 monitors an error in a printing process and, specifically, monitors the occurrence of an error recoverable by the user, such as a paper jam or out of paper.

The operation panel 170 has a function as a touch panel that receives inputs from the user, and also has a function as a display unit that displays information of which the user is to be notified.

The communicating unit 140 performs transmission and reception of information with the PCs 3 via the communication cable 2 and, specifically, receives print data and a print instruction of printing the print data. Also, the communicating unit 140 transmits a secret code, which will be described further below, to the relevant PC 3.

The print job managing unit 150 receives print data from any of the PCs 3 via the communication cable 2, and then manages the print data by adding job identification information for identifying a printing process.

The tray managing unit 120 includes a print sheet calculating unit 121, a tray determining unit 122, a secret code generating unit 123, an obtaining unit 124, and a tray control unit 125. The hard disk 130 stores a sheet holding capacity table 132 and a secret code relational table 134.

The print sheet calculating unit 121 calculates the number of sheets required for printing all pieces of the print data.

Specifically, the number of print sheets is calculated based on the number of pages included in the print data. For example, when the print instruction for the print data indicates that one page is printed on one sheet, the number of print sheets is equal to the number of pages. Also, when the print instruction for the print data indicates that two pages are printed on one sheet, the number of print sheets is a half of the number of pages included in the print data. Furthermore, when the print instruction for the print data indicates double-sided printing, the number of print sheets is a half of the number of pages included in the print data.

The sheet holding capacity table 132 stored in the hard disk 130 contains the output tray identification information for identifying each output tray in association with a maximum number of sheets stackable on each output tray.

The tray determining unit 122 determines an output tray to which the printed sheets are to be output. That is, the tray determining unit 122 determines one of the first output tray 210, the second output tray 220, and the third output tray 230 as an output tray to which the printed sheets are to be output. Specifically, the tray determining unit 122 determines the output tray by referring to the sheet holding capacity table 132 stored in the hard disk 130. At this time, the tray determining unit 122 determines the output tray based on the information from the first output tray 210, the second output tray 220, the third output tray 230, and the printing-completed detecting unit 115.

The secret code generating unit 123 generates a secret code corresponding to the output tray identification information of the output tray determined by the tray determining unit 122. The secret code is a so-called one-time password generated at random. The secret code generating unit 123 sends the generated secret code with the corresponding output tray identification information to the communicating unit 140. The secret code is transmitted to the relevant PC 3 via the communicating unit 140.

The secret code relational table 134 stored in the hard disk 130 contains the secret code generated by the secret code generating unit 123 in association with the output tray identification information corresponding to the secret code. The obtaining unit 124 obtains a secret code from the user via the operation panel 170.

The tray control unit 125 matches the secret code obtained from the obtaining unit 124 against the secret code stored in the hard disk 130 and, when these secret codes coincide with each other, specifies that output tray associated with the secret code. Furthermore, the tray control unit 125 sends the output tray unit 110 an opening instruction that allows the slot of the specified output tray to be open.

FIG. 2 is a table of a data structure of a secret code relational table 134 shown in FIG. 1. The secret code relational table 134 associates output tray IDs for identifying the first output tray 210, the second output tray 220, and the third output tray 230, print data IDs for identifying print data, job IDs provided to the print data, and the secret codes with one another.

In this way, the output tray IDs are associated with the secret codes on the secret code relational table 134. Therefore, when obtaining a secret code, the tray control unit 125 refers to the secret code relational table 134, thereby specifying the output tray corresponding to the obtained secret code.

Figure 3A:
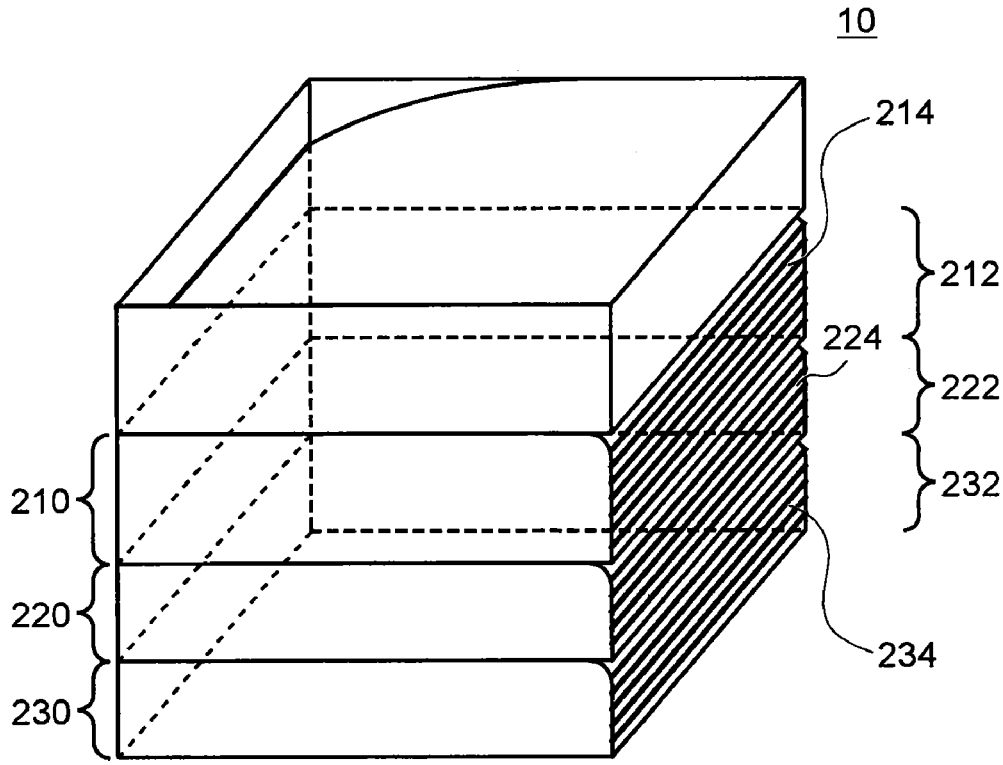
FIG. 3A is an external view of a printer 10.

FIG. 3A is an external view of the printer 10. The printer 10 includes the first output tray 210, the second output tray 220, and the third output tray 230. Printed sheets on which the print data is printed are output to one of the first output tray 210, the second output tray 220, and the third output tray 230 that is determined by the tray control unit 125.

The output trays 210, 220, and 230 are provided on one side with slots 212, 222, and 232, respectively, from which sheets are taken out. Furthermore, the slots 212, 222, and 232 are provided with shutters 214, 224, and 234, respectively. These shutters 214, 224, and 234 are normally closed. This prevents the printed sheets stacked on the output trays from being viewed from others. On receiving an opening instruction from the tray control unit 125, the slot opening unit 111 opens the shutter provided to the slot of the output tray specified by the opening instruction.

Figure 3B:
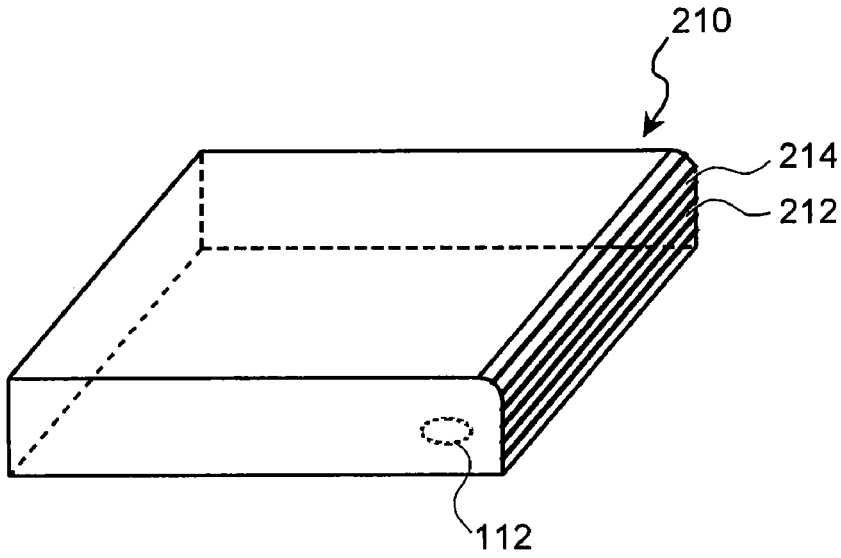
FIG. 3B is an external view of a first output tray 210.

FIG. 3B is an external view of the first output tray 210. The first output tray 210 has provided on its bottom surface the first output tray paper detecting unit 112 implemented by a reflective photosensor. Similarly, the second output tray 220 is provided with the second output tray paper detecting unit 113, and the third output tray 230 is provided with the third output tray paper detecting unit 114.

Figure 4A:
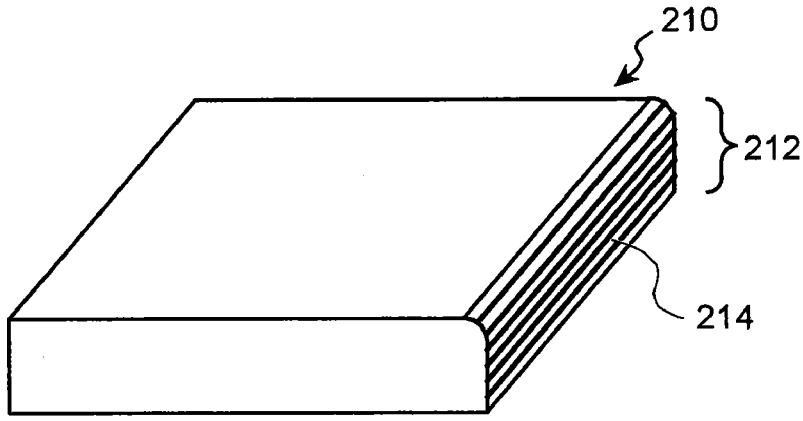
FIGS. 4A, 4B, and 4C are schematics for explaining an opening and closing mechanism of a shutter 214 provided on the first output tray 210.
Figure 4B:
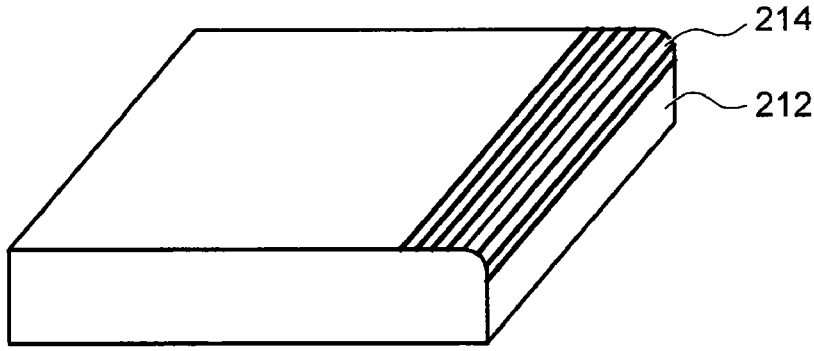
Figure 4C:
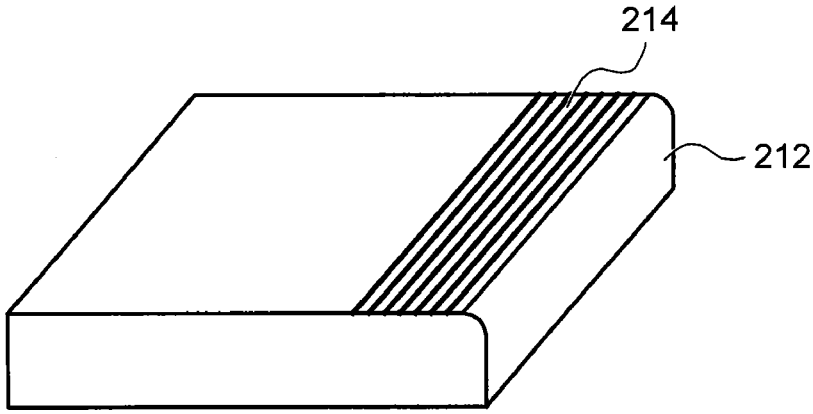

FIGS. 4A, 4B, and 4C are schematics for explaining an opening and closing mechanism of a shutter 214 provided on the first output tray 210. FIG. 4A depicts a state in which the shutter 214 is closed. FIG. 4B depicts a state in which the shutter 214 is half open. FIG. 4C depicts a state in which the shutter 214 is completely open. In this way, with the shutter sliding by a driving mechanism not shown, the slot 212 is opened and closed.

The open and close mechanism of the shutter 224 provided to the second output tray 220 and that of the shutter 234 provided to the third output tray 230 are similar to that of the shutter 214 provided to the first output tray 210.

Figure 5:
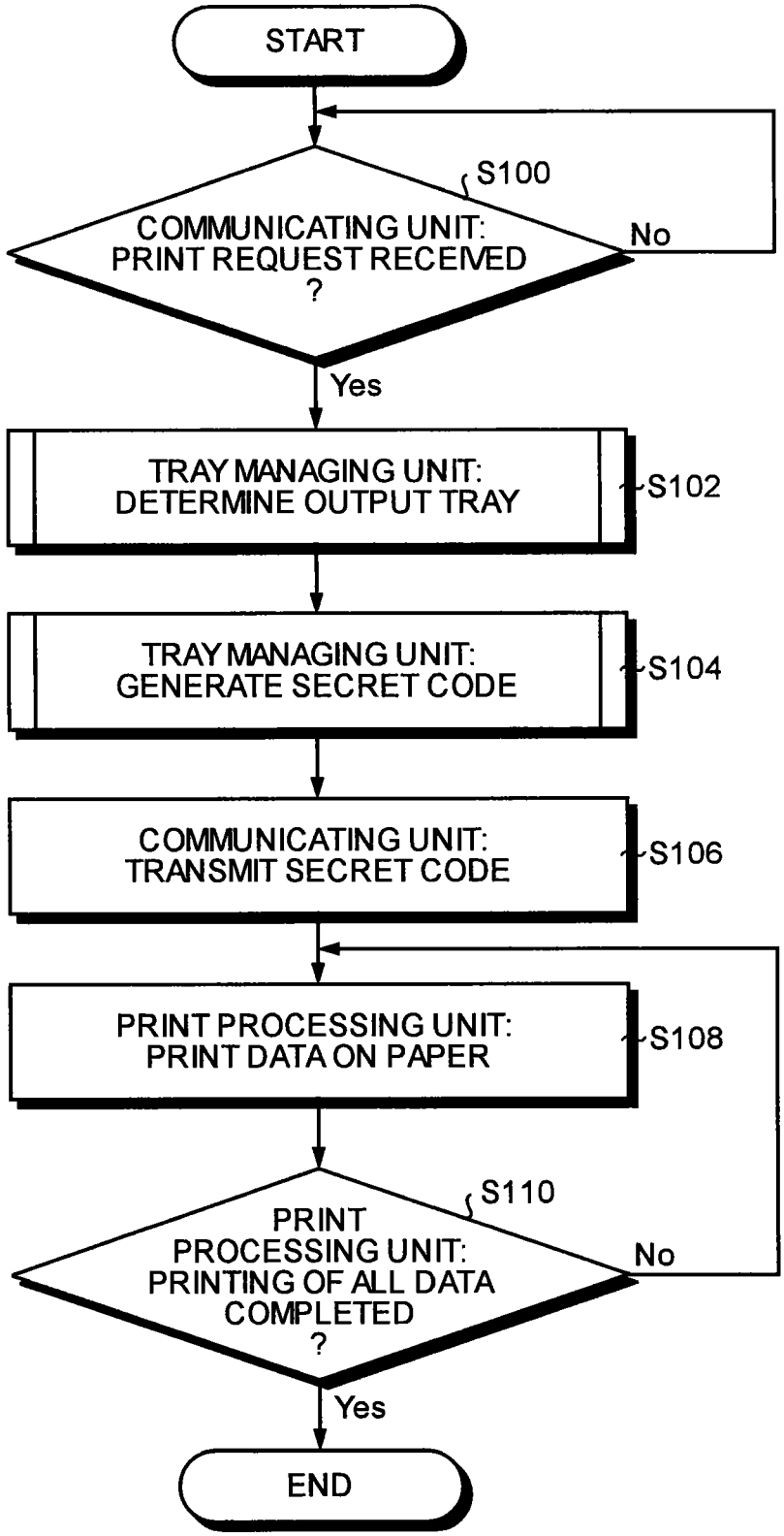
FIG. 5 is a flowchart of a process procedure for an image forming process of the printer 10 upon reception of print data.

FIG. 5 is a flowchart of a process procedure for an image forming process of the printer 10 upon reception of print data. The communicating unit 140 of the printer 10 receives print data with a print request from any one of the PCs 3 via the network (step S100). The tray managing unit 120 determines an output tray to which printed sheets having printed thereon the print data received by the communicating unit 140 are to be output (step S102).

The tray managing unit 120 generates a secret code corresponding to the output tray ID of the determined output tray (step S104). The tray managing unit 120 sends the generated secret code to the communicating unit 140. The communicating unit 140 then transmits the secret code received from the tray managing unit 120 and the output tray ID to the PC 3 via the communication cable 2 (step S106). That is, the user of the PC 3 is notified of the secret code regarding the print data.

The print processing unit 160 prints the print data according to print job management performed by the print job managing unit 150 (step S108). When all pieces of print data are printed on paper (step S110, Yes), the image forming process of the printer 10 is completed.

Figure 6:
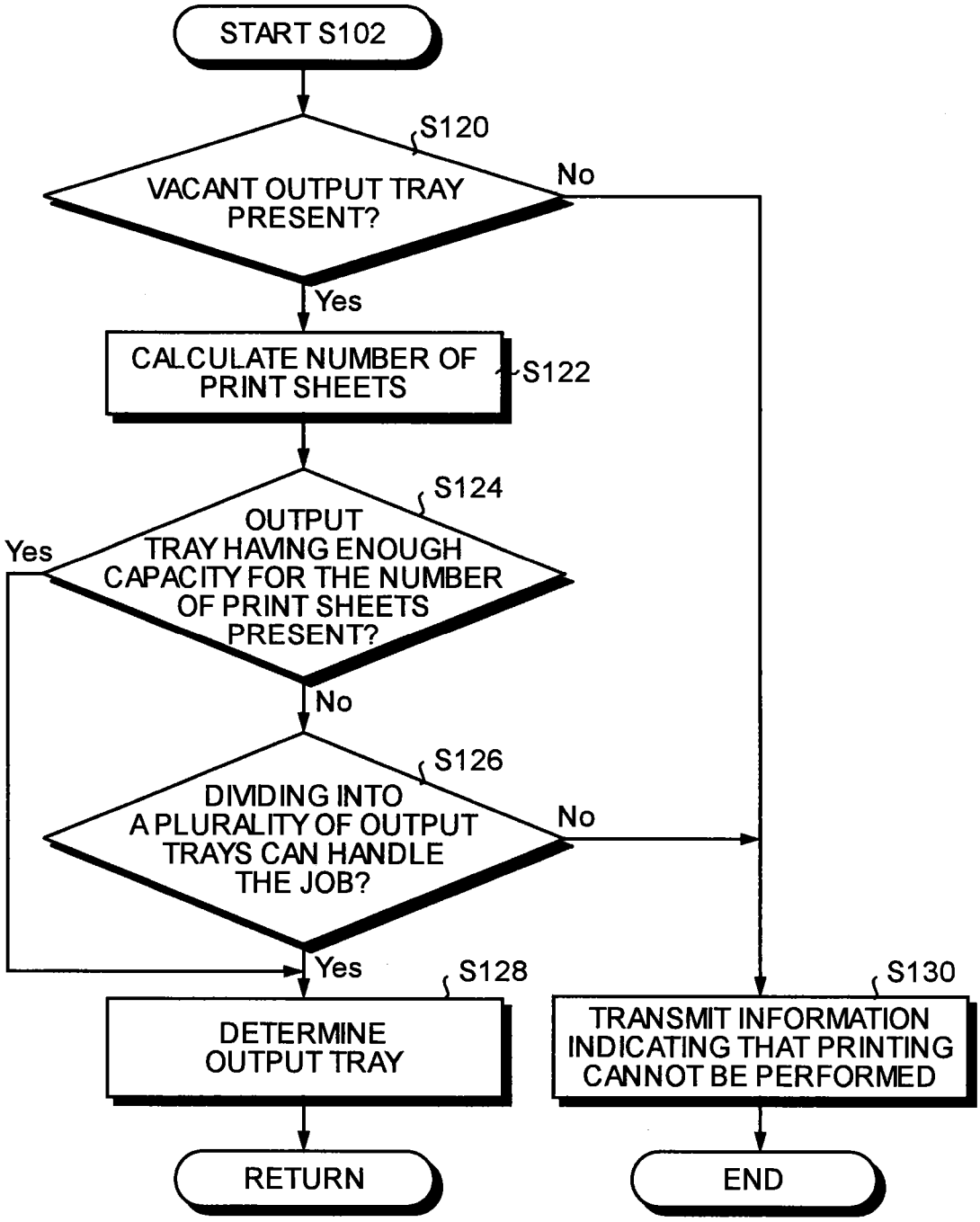
FIG. 6 is a flowchart of a process procedure for an output tray determining process (step S102) shown in FIG. 5 by a tray managing unit 120.

FIG. 6 is a flowchart of a process procedure for an output tray determining process (step S102) shown in FIG. 5 by a tray managing unit 120. The tray determining unit 122 receives a signal indicative of the presence or absence of paper from each of the first output tray paper detecting unit 112, the second output tray paper detecting unit 113, and the third output tray paper detecting unit 114 of the output tray unit 110. When an output tray having no printed paper stacked thereon is present (step S120, Yes), the tray determining unit 122 selects this output tray as the destination to which printed sheets are to be output.

The print sheet calculating unit 121 calculates the number of print sheets required for printing the print data (step S122). The tray determining unit 122 then searches for an output tray having a capacity of holding the print sheets required for printing the print data. At this time, the tray determining unit 122 searches for such an output tray with reference to the sheet holding capacity table 132 stored in the hard disk 130 containing a maximum number of sheets that are stackable, which is associated with each of the output tray ID.

For example, when the number of print sheets for printing the print data is 90, the maximum number of sheets for the first output tray is 100, and the maximum number of sheets for the second output tray is 70, the first output tray is determined as the output tray for the print data.

When an output tray having a capacity of holding the print sheets required for printing is found in vacant trays (step S124, Yes), the found output tray is determined as the output tray for the print data (step S128).

On the other hand, when no output tray having a capacity of holding the print sheets required for printing is present (step S124, No) and the printed sheets can be output to a plurality of output trays in a distributed manner (step S126, Yes), the plurality of output trays are determined as output trays for the print data (step S128). The procedure then goes to the secret code generating process (step S104) described with reference to FIG. 5.

The sheets are output to a plurality of output trays in a distributed manner when, for example, the maximum number of sheets for the first output tray 210 is 100, the maximum number of sheets for the second output tray 220 is 70, and the number of sheets for printing is 120. In this case, if the first output tray 210 and the second output tray 220 are vacant, 120 sheets are output to these two output trays in a distributed manner. In this way, all sheets can be output.

On the other hand, when no vacant tray is present at step S120, that is, when all of the first output tray 210, the second output tray 220, and the third output tray 230 have printed sheets stacked thereon (step S120, No), print-disable information indicating that the print data cannot be printed is sent to the PC 3 via the communicating unit 140 (step S130). This causes the printing procedure to be abandoned.

Also, when all sheets cannot be output even to a plurality of output trays in a distributed manner (step S126, No), print-disable information indicating that the print data cannot be printed is sent to the PC 3 via the communicating unit 140 (step S130). This causes the printing procedure to be abandoned.

Figure 7:
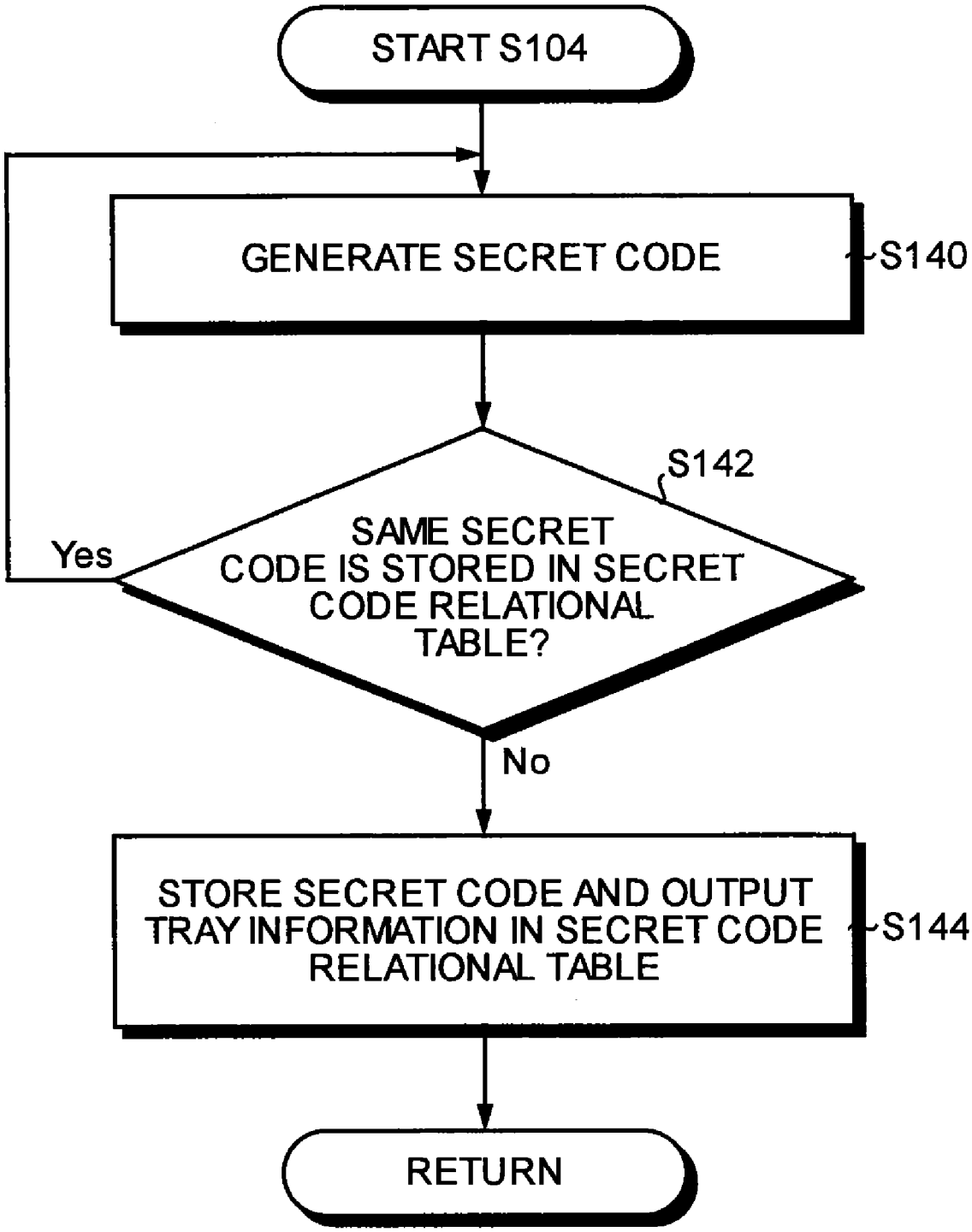
FIG. 7 is a flowchart of a process procedure for a secret code generating process (step S104) shown FIG. 5 by the tray managing unit 120.

FIG. 7 is a flowchart of a process procedure for a secret code generating process (step S104) shown FIG. 5 by the tray managing unit 120.

When the output tray is determined, the secret code generating unit 123 generates a secret code corresponding to the output tray ID of the determined output tray (step S140). The secret code generating unit 123 according to the present embodiment generates a secret code of a random integer. The secret code generating unit 123 then compares the generated secret code with the secret codes stored in the hard disk 130 and, when a secret code identical to the generated secret code is stored in the hard disk 130 (step S142, Yes), returns to step S140 to generate a secret code that is different from any of the previous secret codes.

On the other hand, when a secret code identical to the generated secret code is not stored in the hard disk 130 (step S142, No), the generated secret code is stored in the hard disk 130 (step S144). At this time, on the secret code relational table 134, the secret code and the output tray ID corresponding to that secret code are associated with each other. Furthermore, in the present embodiment, the print data ID and the job ID are further associated with the secret code.

When the secret code generating process is completed, the procedure goes to the secret code reporting process (step S106) described with reference to FIG. 5.

In this way, according to the present embodiment, the secret code for use in user authentication is not information uniquely assigned to each user, but random information generated every time a print instruction is received. This secret code of random information is reported to the user issuing the print instruction. With this secret code, user authentication is performed. This makes it possible to perform user authentication without setting a secret code unique to each user in advance. Also, it is possible to prevent the inconvenience that only the user to which a secret code is set in advance can use the present system.

Since the secret code according to the present embodiment is random information, the security level can be increased compared with the case where user authentication is performed with a secret code unique to the user.

Figure 9:
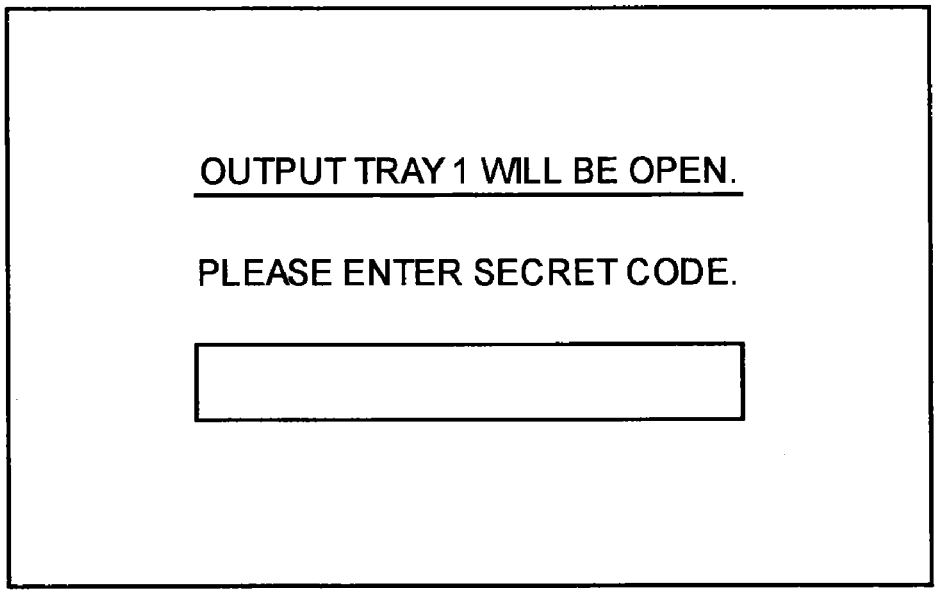
FIG. 9 is a schematic of a secret code input screen.

FIG. 8 is a flowchart of a process procedure for releasing a tray of the printer 10. When the user enters an output tray ID through the operation panel 170, the obtaining unit 124 obtains the secret code (step S200). Next, the tray control unit 125 matches the state of use of the output tray specified by the output tray ID obtained by the obtaining unit 124. When the output of printed sheets to that output tray has been completed (step S202), a secret code input screen is displayed on the operation panel 170 (step S204). FIG. 9 is a schematic of a secret code input screen. According to the display of the screen, the user enters the secret code transmitted to the PC 3 from the printer 10.

When the secret code is entered by the user (step S206, Yes), the tray control unit 125 matches the entered secret code and tray ID against the secret code and tray ID transmitted to the PC 3 via the communicating unit 140 (step S108). As a result of matching, when they coincide with each other (step S210, Yes), the tray control unit 125 sends an instruction of opening the output tray to the slot opening unit 111 of the output tray unit 110. On receiving the opening instruction, the slot opening unit 111 opens the shutter of the specified output tray (step S212).

When the user removes the printed sheets from the output tray, the output tray paper detecting unit detects that the tray is vacant (step S214, Yes). In this case, the tray control unit 125 receives, from the printing-completed detecting unit 115, information that the tray is vacant. When the signal indicating that the tray is vacant is received, the tray control unit 125 deletes the secret code stored in the hard disk 130 in association with the tray ID (step S216). At this time, the print data ID and the job ID associated with the tray ID are also deleted. This ends the output tray controlling process.

Figure 10:
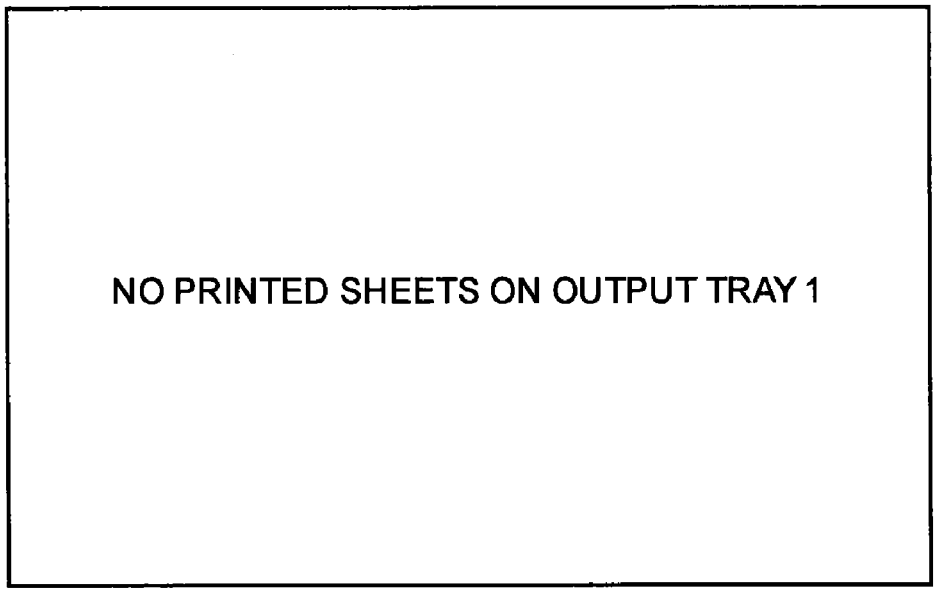
FIG. 10 is a schematic of a display screen on an operation panel 170.

In step S202, when no printed sheets are stacked on the relevant output tray (step S202, No), the operation panel 170 is caused to display information indicating that no printed sheets are stacked on the output tray specified by the user (step S220). This causes the procedure to be aborted. FIG. 10 is a schematic of a display screen on an operation panel 170.

Also, when the secret code and tray ID entered by the user and those stored in the hard disk 130 do not coincide with each other, the operation panel is caused to display information indicating that they do not coincide with each other (step S222). This causes the procedure to be aborted.

Figure 11:
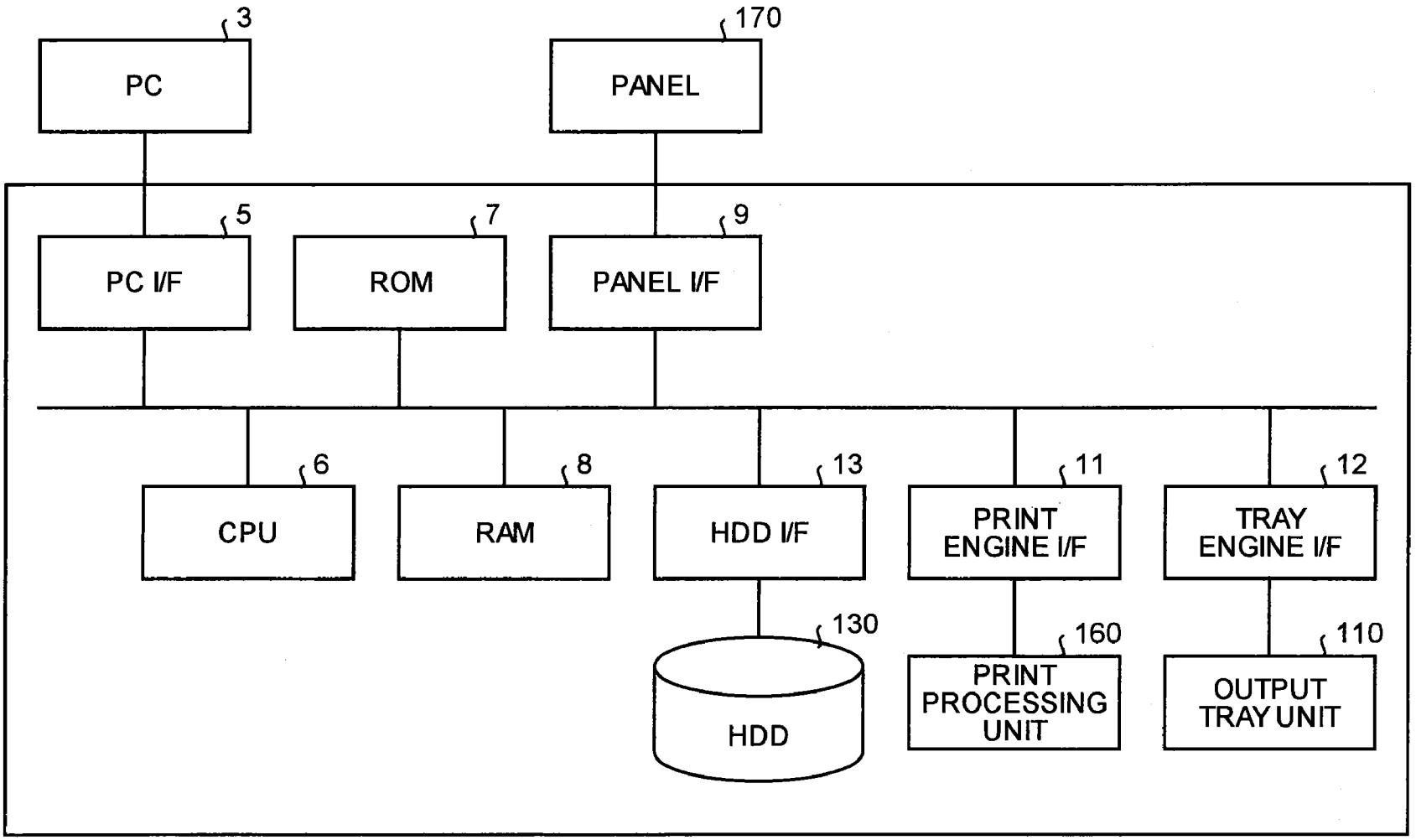
FIG. 11 is a block diagram of a hardware structure of the printer 10.

FIG. 11 is a block diagram of a hardware structure of the printer 10. The printer 10 includes a terminal interface (I/F) 5, a central processing unit (CPU) 6, a read only memory (ROM) 7, a random access memory (RAM) 8, the operation panel 170, a panel I/F 9, the hard disk 130, an hard disk I/F 13, the print processing unit 160, a print engine I/F 11, the output tray unit 110, and a tray engine I/F 12. The hard disk 130 is a large-capacity, non-volatile memory for holding stored print data.

The print processing unit 160 forms electrostatic latent images on a photosensitive material not shown, develops the images, and is supplied with transfer paper from a paper supply unit not shown for transfer and fusing, thereby forming images on print sheets. That is, the print processing unit 160 described in the Detailed Description unit forms a printing unit in the present invention.

The CPU 6 is a controlling mechanism that receives and expands, and print data sent from the PCs 3, stores the print data in the RAM 8, and sends the print data held in the RAM 8 to the print processing unit 160.

The terminal I/F 5 is an interface with the PCs 3. The terminal I/F 5 receives information, such as print data and a print instruction from the PCs 3. The CPU 6 processes data, such as print data, according to programs stored in the ROM 7 and the RAM 8. The ROM 7 stores programs mainly used for managing data and controlling peripheral modules, such as the operation panel 170 and the print processing unit 160.

The RAM 8 is used as various storage areas, such as a work memory for the CPU 6 to perform processing, a page buffer for data management per page and temporary storage, and a bit map memory for converting data stored in the page buffer to an actual print pattern and storing print data.

The panel I/F 9 is an interface with the operation panel 170. The hard disk I/F 13 is an interface with the hard disk 130. The print engine unit I/F 11 is an interface for transmitting and receiving a signal, such as a control signal and video signal from the CPU 6 to the print processing unit 160, and a status signal from the print processing unit 160 to the CPU 6.

An image forming program for performing the image forming process of the printer 10 is supplied as being recorded on a computer-readable recording medium, such as a CD-ROM, a floppy disk (FD), and a digital versatile disk (DVD), as a file in an installable or executable format.

Also, the image forming program according to the present embodiment may be supplied as being stored in a computer connected to a network, such as the Internet, and then being downloaded via the network.

In this case, the image forming program is loaded on the main storage device in a manner such that the image forming program is read in the printer 10 from the recording medium and then each unit described in the software structure is generated on the main storage device.

Figure 12:
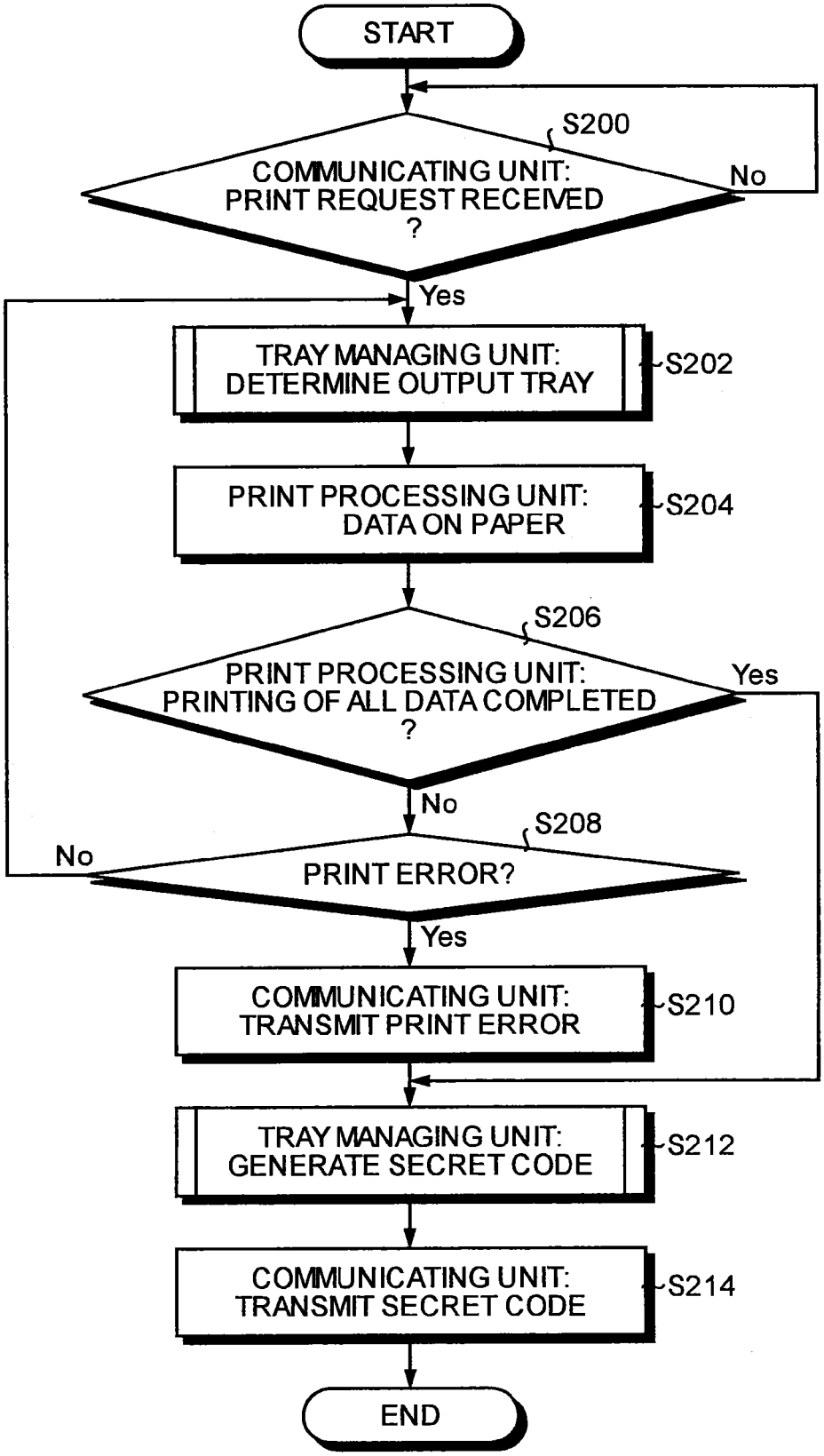
FIG. 12 is a flowchart of an image forming process of the printer 10 according to a second embodiment of the present invention.

FIG. 12 is a flowchart of an image forming process of the printer 10 according to a second embodiment of the present invention. The image forming system 1 according to the second embodiment generates a secret code when the process of printing the print data is completed, and then transmits the secret code to the PC 3 of the user. In this point, the image forming system 1 according to the second embodiment is different from the image forming system according to the first embodiment.

As with the first embodiment, the communicating unit 140 of the printer 10 receives a print request with print data from any of the PCs 3 via the communication cable 2 (step S200). The tray managing unit 120 then determines the output tray to which printed sheets having printed thereon the print data received by the communicating unit 140 is to be output (step S202).

The print processing unit 160 prints the print data on paper according to print job management in the print job managing unit 150 (step S204). On completion of printing all pieces of print data on paper (step S206, Yes), the tray managing unit 120 generates a secret code corresponding to the output tray ID of the output tray to which the printed sheets were output (step S212). This secret code generating process (step S212) is similar to the secret code generating process at step S104 described with reference to FIG. 7 in the first embodiment.

The communicating unit 140 transmits the secret code and output tray ID received from the tray managing unit 120 to the PC 3 via the communicating cable 2 (step S214). This ends the image forming process of the printer 10.

In this way, the printer 10 according to the second embodiment generates a secret code when the process of printing the print data is completed.

On the other hand, when the error monitoring unit 116 detects an error while the printer processing unit 160 is performing the printing process (step S206, No and step S208, Yes), the communicating unit 140 transmits error information indicative of the occurrence of an error to the PC 3 (step S210). The procedure then goes to step S212.

In this way, when an error occurs, a secret code is sent to the user before the completion of the printing process. Therefore, the user can take out the printed sheets completed before the occurrence of the error.

Also, in the course of the process of printing the print data, when the number of printed sheets exceeds the maximum number of sheets for the output tray (step S206, No and step S208, No), the tray managing unit 120 re-determines another vacant output tray as the destination to which printed sheets are to be output (step S202). The print processing unit 160 then resumes the printing process (step S204).

Figure 13:
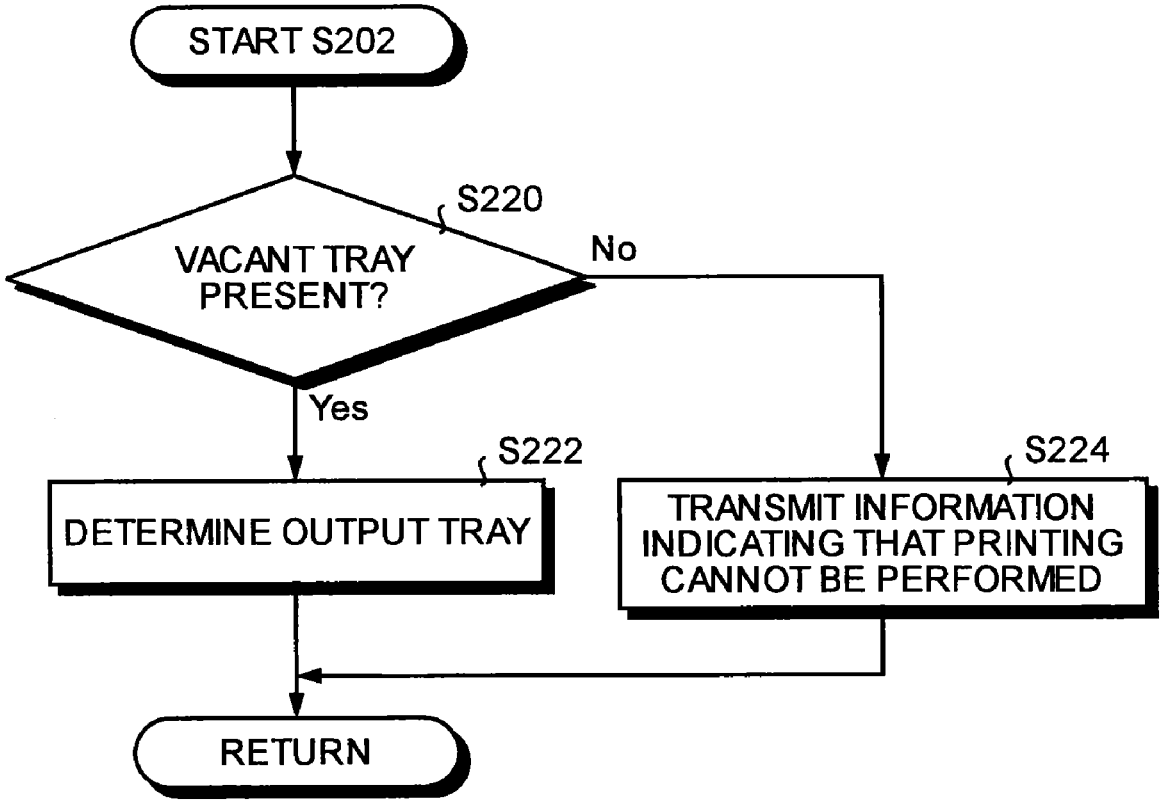
FIG. 13 is a flowchart of process procedure for an output tray determining process (step S202) shown in FIG. 12 by the tray managing unit 120.

FIG. 13 is a flowchart of process procedure for an output tray determining process (step S202) shown in FIG. 12 by the tray managing unit 120.

The tray determining unit 122 receives a signal indicative of the presence or absence of paper from each of the first output tray paper detecting unit 112, the second output tray paper detecting unit 113, the third output tray paper detecting unit 114 of the output tray unit 110. When an output tray having no printed sheets stacked thereon is present (step S220, Yes), the tray determining unit 122 determines this output tray as the destination to which printed sheets are to be output (step S222).

On the other hand, when no output tray having a capacity of holding the required sheets (step S220, No), print-disable information indicating that the print data cannot be printed is transmitted to the PC 3 via the communicating unit 140 (step S224). On completion of the process, the procedure goes to step S204, which has been described with reference to FIG. 12.

In this way, in the image forming system 1 according to the second embodiment, the secret code is transmitted after the print job is completed. Therefore, the user can know the completion of the printing process on receiving the secret code.

Alternatively, in the secret code transmitting process (step S214), printing-completed information indicative of the completion of output of the print data may be transmitted with the secret code and the output tray ID.

Other than the described, the structure and operation of the image forming system 1 according to the second embodiment are similar to those of the image forming system 1 according to the first embodiment.

Figure 14:
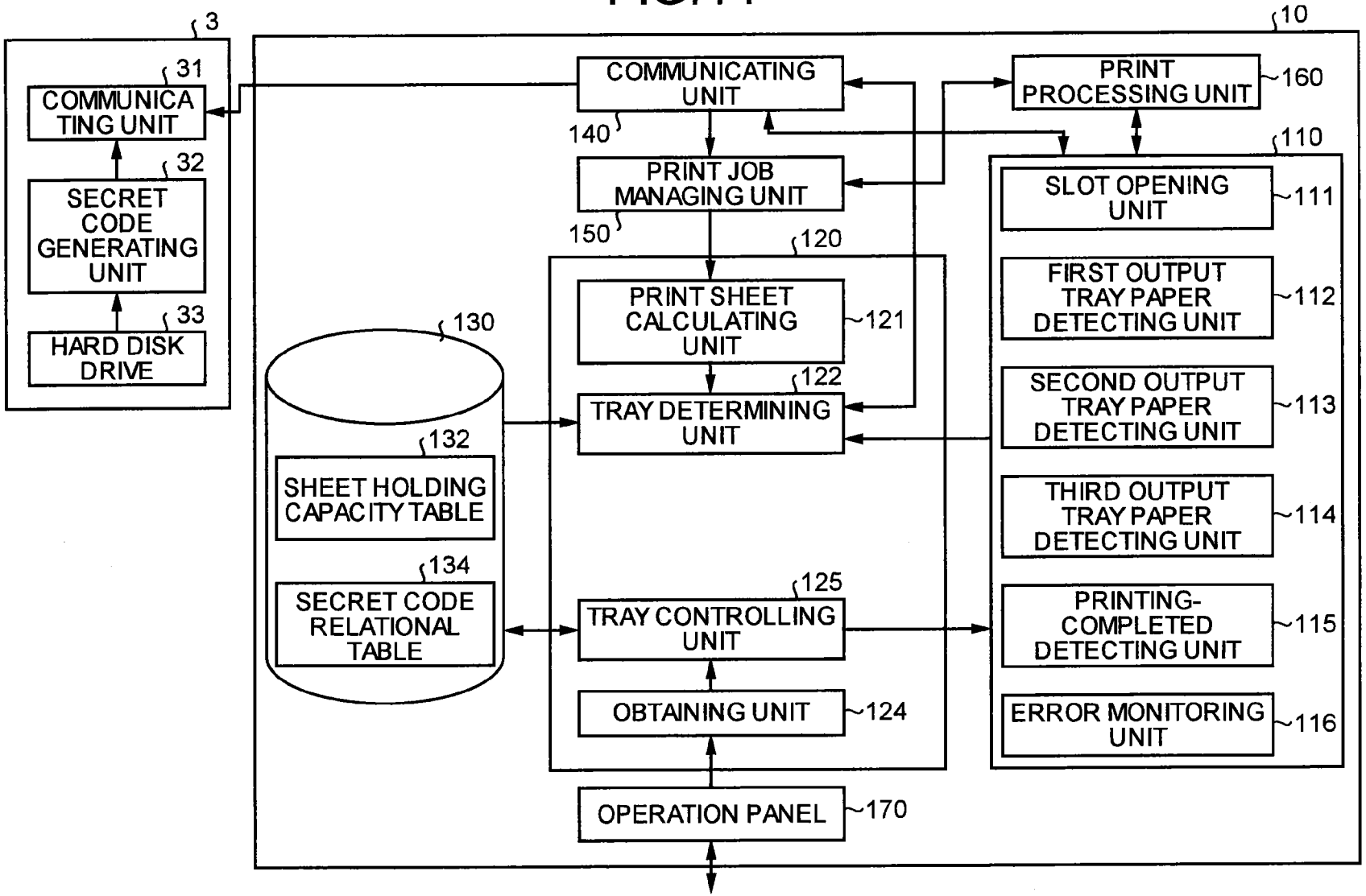
FIG. 14 is a schematic of an image forming system 1 according to a third embodiment of the present invention.

FIG. 14 is a schematic of an image forming system 1 according to a third embodiment of the present invention. In the image forming system 1 according to the third embodiment, the PC 3 generates a secret code. In this point, the image forming system 1 according to the third embodiment is different from the image forming systems 1 according to the first and second embodiments, in which the printer 10 generates a secret code for transmission to the relevant PC 3.

A printer 10 according to the third embodiment does not include the secret code generating unit 123. In this point, the printer 10 according to the third embodiment is different from the printers 10 according to the first and second embodiments. The PC 3 according to the third embodiment includes a communicating unit 31, a secret code generating unit 32, and a hard disk 33.

The communicating unit 31 performs transmission and reception of information with the printer 10 via the communication cable 2. The hard disk 33 stores a terminal ID, which is identification information unique to each terminal. The secret code generating unit 32 generates a secret code based on the output tray ID received from the printer 10 via the communicating unit 31 and the terminal ID stored in the hard disk 33. Specifically, a secret code corresponding to the output tray ID is generated, and then the terminal ID is added to the head of the generated secret code. That is, the secret code provided with the terminal ID is used as the secret code for actual use. In this way, the secret code includes the terminal ID provided according to predetermined rules. Here, the predetermined rules are similarly set to each PC 3 included in the image forming system 1. In this way, all PCs 3 included in the image forming system 1 generates a secret code including its unique terminal ID according to the predetermined rules. This can prevent each terminal from generating the same secret code.

Figure 15:
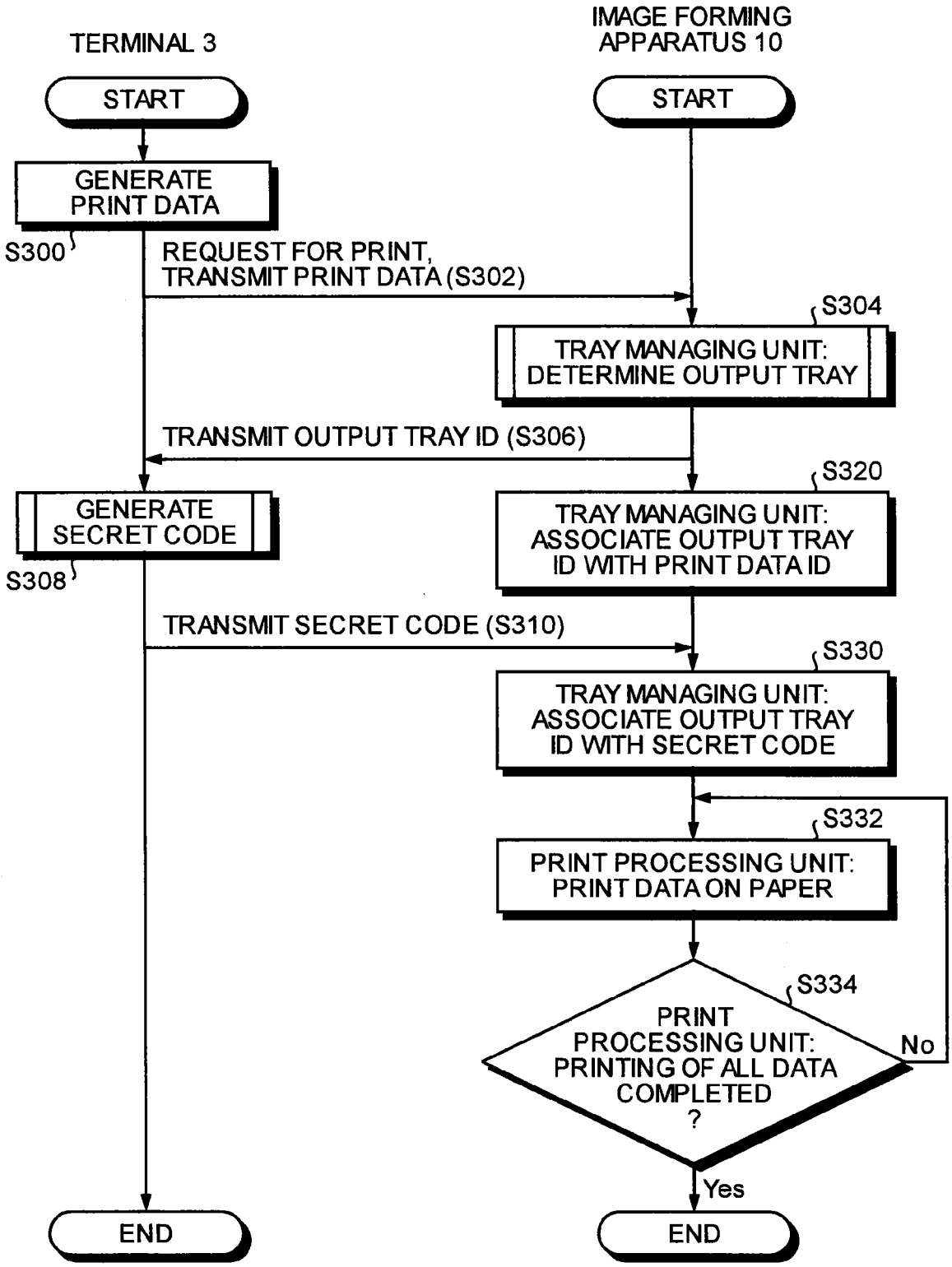
FIG. 15 is a flowchart of an image forming process of the image forming system 1 according to the third embodiment.

FIG. 15 is a flowchart of an image forming process of the image forming system 1 according to the third embodiment.

The PC 3 generates print data (step S300). The PC 3 then transmits the generated print data and a print request regarding the print data to the printer 10 (step S302). When the communicating unit 140 of the printer 10 receives the print data and the print request, the tray managing unit 120 determines which output tray to use (step S304). The communicating unit 140 then transmits the output tray ID of the output tray determined by the tray managing unit 120 to the PC 3 originating the print request (step S306).

On receiving the output tray ID, the PC 3 generates a secret code based on the received output tray ID and the terminal ID held in the hard disk 33 (step S308).

The secret code generating unit 32 generates a random secret code. When the generated secret code is "09081", the terminal ID "A001" is added to the generated secret code, and "A00109081" is taken as the secret code for actual use.

In this way, each terminal generates a random secret code with its unique terminal ID being added to its head. This prevents the printer 10 from receiving the same secret code from a plurality of terminals.

The communicating unit 31 of the PC 3 transmits the secret code generated by the secret code generating unit 32 to the printer 10 via the communication cable 2 (step S310).

On the other hand, the tray managing unit 120 of the printer 10 stores the output tray ID of the output tray determined by the tray determining unit 122 in the hard disk 130 in association with the print data ID for identifying the print data received by the communicating unit 140.

Furthermore, when the communicating unit 140 of the printer 10 receives the secret code, the tray managing unit 120 stores the secret code in the hard disk 130 in association with the transmitted output tray ID (step S330).

The print processing unit 160 prints the print data on paper according to print job management by the print job managing unit 150 (step S332). When all pieces of the print data are printed on paper (step S334, Yes), the image forming process of the printer 10 is completed. In this way, according to the third embodiment, the PC 3 generates a secret code.

While the invention has been described by using the embodiments, numerous other modifications and improvements can be added to the embodiments.

As a first example of such modifications, as for print data obtained by the printer 10 and not yet completely printed, the tray determining unit 122 may determine an output tray other than the output tray previously determined as the output tray for that print data.

Specifically, when the first output tray has been previously determined as the output destination for the print data managed by the print job managing unit 150 and has not yet been printed, even though no sheets of paper are stacked on the first output tray, the first output tray is excluded from candidates for the output tray for that print data.

This prevents sheets of two or more different pieces of print data from being simultaneously output to the same output tray.

As has been described in the foregoing, according to the present invention, the secret information generating unit generates secret information corresponding to output tray identification information. When the matching unit successfully finds that the generated secret information and secret information entered by the user coincide with each other, the tray control unit allows the slot of the output tray to be open. Therefore, people other than a person obtaining the secret information cannot open the shutter of the slot of the output tray on which the printed sheets are stacked, thereby achieving an effect of ensuring the confidentiality of the printed matter.

Also, the secret information is generated per printed data. This achieves an effect of preventing the secret information from being deciphered and ensuring a higher security level compared with the case where unique secret information is allocated to each user.

Furthermore, the secret information is not unique to the user. This achieves an effect of saving people other than a specific person the inconvenience of not being able to print.

According to the present invention, the transmitting unit transmits the secret information on completion of the printing process. Therefore, the user can know the completion of the printing process on receiving the secret information, and does not have to wait in front of the image forming apparatus for the completion of printing. This achieves an effect of improving the usability of the image forming apparatus.

Furthermore, according to the present invention, on completion of the printing process, the transmitting unit transmits information indicating that the printing process is completed with the secret information. Therefore, the user can receive a notification indicative of the completion of printing with the secret information, and does not have to wait in front of the image forming apparatus for the completion of printing. This achieves an effect of improving the usability of the image forming apparatus.

Moreover, according to the present invention, the transmitting unit transmits the secret information when the output tray is determined. This achieves an effect of allowing the user to obtain the secret information at the time when the output tray is determined and then obtain, at a desired time, printed sheets stacked on the output tray.

Furthermore, according to the present invention, the secret information is generated correspondingly to print data identification information. Therefore, the print data corresponding to the secret information can be identified. This allows the printed sheets to be managed per print data, thereby achieving an effect of ensuring the confidentiality of the printed matter per print data.

Moreover, according to the present invention, the secret information is generated correspondingly to job identification information. Therefore, a job corresponding to the secret information can be identified. This allows the printed sheets to be managed per print job, thereby achieving an effect of ensuring the confidentiality of the printed matter per print job.

Furthermore, according to the present invention, a relational table for associating tray identification information with the secret information is provided. This achieves an effect of allowing the tray control unit to easily specify the output tray to be opened based on the relation contained in the relational table.

Moreover, according to the present invention, the tray determining unit determines, as an output tray for the print data, the output tray detected by the paper detecting unit as not having stacked thereon printed sheets. This prevents the printed sheets from being output to the output tray already having stacked thereon printed sheets for other print data. In this manner, printed sheets for a plurality of pieces of print data are prevented from being output to and then stacked on a single output tray. This achieves an effect of ensuring the confidentiality of the printed matter.

Furthermore, according to the present invention, the tray determining unit determines an output tray other than the output tray previously determined for print data in a print wait state as the output tray for that print data. Therefore, printed sheets are prevented from being output to and then stacked on the output tray already having stacked thereon printed sheets for other print data. In this manner, printed sheets for a plurality of pieces of print data are prevented from being output to and stacked on a single output tray. This achieves an effect of ensuring the confidentiality of the printed matter.

Moreover, according to the present invention, the print sheet calculating unit calculates the number of print sheets required for printing the print data obtained by the print data obtaining unit. Based on the number of print sheets calculated by the print sheet calculating unit and the number of sheets stackable on each of the output trays, the tray determining unit determines an output tray having a capacity of holding the print sheets as the output tray for the print data. This achieves an effect of allowing all print sheets for the print data to be output to a single output tray that can be opened with the secret information.

Furthermore, according to the present invention, when the number of print sheets exceeds the number of sheets stackable on a single output tray, the tray determining unit determines a plurality of output trays as output trays for the print data. The secret information generating unit then generates secret information corresponding to tray identification information of these output trays. Therefore, when the printed sheets are output to the output trays in a distributed manner, the output trays can be opened with single secret information. Therefore, as with the case where the sheets are output to a single output tray, the effect of ensuring the confidentiality of the printed matter can be achieved.

Moreover, according to the present invention, when the error monitoring unit detects an error, the transmitting unit transmits secret information. Therefore, the user can obtain the secret information when an error is detected. This achieves an effect of allowing the sheets printed before the error occurs to be taken out.

Furthermore, according to the present invention, the secret code generating unit generates secret code corresponding to the output tray identification information. The tray control unit allows the slot of the output tray to be open when the matching unit successfully finds that the generated secret information and secret information entered by the user coincide with each other as a result of comparison. Therefore, people other than a person obtaining the secret information cannot open the shutter of the slot of the output tray on which the printed sheets are stacked, thereby achieving an effect of ensuring the confidentiality of the printed matter.

Moreover, according to the present invention, each of the terminals generates secret information including its own terminal identification information. This achieves an effect of preventing the same secret information from being obtained from the terminals.

Furthermore, according to the present invention, the secret information generating unit generates secret information corresponding to the output tray identification information. When the matching unit successfully finds that the generated secret information and secret information entered by the user coincide with each other, the tray control unit allows the slot of the output tray to be open. Therefore, people other than a person obtaining the secret information cannot open the shutter of the slot of the output tray on which the printed sheets are stacked, thereby achieving an effect of ensuring the confidentiality of the printed matter.

Moreover, according to the present invention, secret information corresponding to the output tray identification information is generated. When it is successfully found that the generated secret information and secret information entered by the user coincide with each other, the slot of the output tray is allowed to be open. Therefore, people other than a person obtaining the secret information cannot open the shutter of the slot of the output tray on which the printed sheets are stacked, thereby achieving an effect of ensuring the confidentiality of the printed matter.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus having a plurality of output trays for stacking sheets on which print data obtained from a terminal via a network is printed, comprising:

a print data obtaining unit that obtains the print data;

a printing unit that prints the print data on a sheet;

a tray determining unit that determines, from among the output trays, an output tray for the sheet on which the print data is to be printed by determining a number of sheets to be used to print the print data, and determining an output tray which has a capacity to store the number of sheets to be used to print the print data, to generate output tray identification information;

a secret information generating unit that randomly generates first secret information corresponding to the output tray identification information;

a transmitting unit that transmits the first secret information and the output tray identification information to the terminal;

an input accepting unit that accepts an input of identification information of a specified output tray from a user and, when an output of printed sheets to the specified output tray is complete, accepts input of second secret information from the user;

a matching unit that matches the second secret information with the first secret information; and a tray control unit that allows a slot of the specified output tray to be open, upon the matching unit successfully matching the second secret information with the first secret information.

2. The image forming apparatus according to claim 1, wherein the transmitting unit transmits the first secret information upon the printing unit completing a printing process of the print data.

3. The image forming apparatus according to claim 2, wherein the transmitting unit transmits the first secret information and information indicating that an output is completed upon the printing unit completing a printing process of the print data.

4. The image forming apparatus according to claim 1, wherein the transmitting unit transmits the first secret information upon the tray determining unit determining the output tray.

5. The image forming apparatus according to claim 1, wherein the first secret information corresponds to print data identification information for identifying the print data.

6. The image forming apparatus according to claim 1, wherein the print data obtaining unit assigns job identification information for identifying a print process to the print data, and the first secret information corresponds to the job identification information.

7. The image forming apparatus according to claim 1, further comprising a memory that stores a relational table for associating the output tray identification information with the first secret information, wherein the tray control unit allows the slot of the specified output tray to be open according to the first secret information and the relational table.

8. The image forming apparatus according to claim 1, further comprising a paper detecting unit that detects, for each of the output trays, whether a sheet is stacked on an output tray of the output trays, wherein the tray determining unit determines an output tray detected not to have a stacked sheet as the output tray for the print data.

9. The image forming apparatus according to claim 1, wherein the tray determining unit determines an output tray other than an output tray previously determined in a process wait state as the output tray for the print data.

10. The image forming apparatus according to claim 1, further comprising a print sheet calculating unit that calculates a number of print sheets required for printing the print data, wherein the tray determining unit determines the output tray based on the number of print sheets and a maximum number of sheets available in each of the output trays.

11. The image forming apparatus according to claim 10, wherein when the number of print sheets exceeds the maximum number of sheets available, the tray determining unit determines more than one output tray for the print data, and the secret information generating unit generates the first secret information corresponding to tray identification information of the more than one output tray.

12. The image forming apparatus according to claim 1, further comprising an error monitoring unit that monitors the printing process of the printing unit, wherein the transmitting unit transmits the first secret information upon the error monitoring unit detecting an error.

13. An image forming system comprising:

an image forming apparatus having a plurality of output trays for stacking sheets on which print data is printed; and a terminal that transmits the print data to the image forming apparatus, wherein the image forming apparatus includes a print data obtaining unit that obtains the print data, a printing unit that prints the print data on a sheet, a tray determining unit that determines, from among the output trays, an output tray for the sheet on which the print data is to be printed by determining a number of sheets to be used to print the print data, and determining an output tray which has a capacity to store the number of sheets to be used to print the print data, to generate output tray identification information, and a first transmitting unit that transmits the output tray identification information to the terminal, and the terminal includes a first receiving unit that receives the output tray identification information from the image forming apparatus, a secret information generating unit that randomly generates first secret information corresponding to the output tray identification information, and a second transmitting unit that transmits the first secret information to the image forming apparatus, and the image forming apparatus further includes a second receiving unit that receives the first secret information from the terminal, an input accepting unit that accepts an input of identification information of a specified output tray from a user and, when an output of printed sheets to the specified output tray is complete, accepts input of second secret information from a user, a matching unit that matches the second secret information with the first secret information, and a tray control unit that allows a slot of the specified output tray to be open, upon the matching unit successfully matching the second secret information with the first secret information.

14. The image forming system according to claim 13, wherein the system includes a plurality of the terminals, each of the terminals further includes a terminal identification information holding unit that holds terminal identification information for identifying the terminal, and the secret information generating unit generates the first secret information including the terminal identification information.

15. An image forming apparatus having a plurality of output trays for stacking sheets on which print data obtained from a terminal via a network is printed, comprising:

a print data obtaining unit that obtains the print data;

a printing unit that prints the print data on a sheet;

a tray determining unit that determines, from among the output trays, an output tray for the sheet on which the print data is to be printed by determining a number of sheets to be used to print the print data, and determining an output tray which has a capacity to store the number of sheets to be used to print the print data, to generate output tray identification information;

a transmitting unit that transmits the output tray identification information;

a receiving unit that receives first secret information generated by the terminal as a response to the tray identification information transmitted, the first secret information being randomly generated and corresponding to the tray identification information;

an input accepting unit that accepts an input of identification information of a specified output tray from a user and, when an output of printed sheets to the specified output tray is complete, accepts input of second secret information from a user;

a matching unit that matches the second secret information with the first secret information; and a tray control unit that allows a slot of the specified output tray to be open, upon the matching unit successfully matching the second secret information with the first secret information.

16. An image forming method for an image forming apparatus having a plurality of output trays for stacking sheets on which print data obtained from a terminal via a network is printed, comprising:

obtaining the print data;

printing the print data on a sheet;

determining, from among the output trays, an output tray for the sheet on which the print data is to be printed by determining a number of sheets to be used to print the print data, and determining an output tray which has a capacity to store the number of sheets to be used to print the print data, to generate output tray identification information;

randomly generating first secret information corresponding to the output tray identification information for identifying the output tray determined;

transmitting the first secret information and the output tray identification information to the terminal;

accepting an input of identification information of a specified output tray from a user;

accepting input of second secret information from the user, when an output of printed sheets to the specified output tray is complete;

matching the second secret information with the first secret information; and allowing a slot of the specified output tray to be open, upon successfully matching the second secret information with the first secret information.

17. The image forming method according to claim 16, wherein the transmitting transmits the first secret information upon the printing completing a printing process of the print data.

18. The image forming method according to claim 17, wherein the transmitting transmits the first secret information and information indicating that an output is completed upon the printing completing a printing process of the print data.

19. The image forming method according to claim 16, wherein the transmitting transmits the first secret information upon the determining generating the output tray identification information.

20. The image forming method according to claim 16, wherein the first secret information corresponds to print data identification information for identifying the print data.

21. The image forming method according to claim 16, further comprising assigning job identification information for identifying a print process to the print data obtained, wherein the first secret information corresponds to the job identification information.

22. The image forming method according to claim 16, further comprising storing a relational table for associating the output tray identification information with the first secret information, wherein the allowing allows the slot of the specified output tray to be open according to the first secret information and the relational table.

23. The image forming method according to claim 16, further comprising detecting, for each of the output trays, whether a sheet is stacked on an output tray of the output trays, wherein the determining determines an output tray detected not to have a stacked sheet as the output tray for the print data.

24. The image forming method according to claim 16, wherein the determining determines an output tray other than an output tray previously determined in a process wait state as the output tray for the print data.

25. The image forming method according to claim 16, further comprising calculating a number of print sheets required for printing the print data, wherein the determining determines the output tray based on the number of print sheets and a maximum number of sheets available in each of the output trays.

26. The image forming method according to claim 25, wherein when the number of print sheets exceeds the maximum number of sheets available, the determining determines more than one output tray for the print data, and the generating generates the first secret information corresponding to tray identification information of the more than one output tray.

27. The image forming method according to claim 16, further comprising monitoring the printing process of the printing, wherein the transmitting transmits the first secret information upon the monitoring detecting an error.

28. An image forming method for an image forming system including an image forming apparatus having a plurality of output trays for stacking sheets on which print data is printed and a terminal that transmits the print data to the image forming apparatus, comprising:

steps in the image forming apparatus including obtaining the print data, printing the print data on a sheet, determining, from among the output trays, an output tray for the sheet on which the print data is to be printed by determining a number of sheets to be used to print the print data, and determining an output tray which has a capacity to store the number of sheets to be used to print the print data, to generate output tray identification information, and transmitting the output tray identification information to the terminal, and steps in the terminal including receiving the output tray identification information from the image forming apparatus, randomly generating first secret information corresponding to the output tray identification information, and transmitting the first secret information to the image forming apparatus, and steps in the image forming apparatus further including receiving the first secret information from the terminal, accepting an input of identification information of a specified output tray from a user, accepting input of second secret information from a user, when an output of printed sheets to the specified output tray is complete, matching the second secret information with the first secret information, and allowing a slot of the specified output tray to be open, upon successfully matching the second secret information with the first secret information.

29. The image forming method according to claim 28, wherein the system includes a plurality of the terminals, steps in each of the terminals include holding terminal identification information for identifying the terminal, and the randomly generating generates the first secret information including the terminal identification information.

30. An image forming method for an image forming apparatus having a plurality of output trays for stacking sheets on which print data obtained from a terminal via a network is printed, comprising:

obtaining the print data;

printing the print data on a sheet;

determining, from among the output trays, an output tray for the sheet on which the print data is to be printed by determining a number of sheets to be used to print the print data, and determining an output tray which has a capacity to store the number of sheets to be used to print the print data, to generate output tray identification information;

transmitting the output tray identification information;

receiving first secret information generated by the terminal as a response to the tray identification information transmitted, the first secret information being randomly generated and corresponding to the tray identification information;

accepting an input of identification information of a specified output tray from a user;

accepting input of second secret information from a user, when an output of printed sheets to the specified output tray is complete;

matching the second secret information with the first secret information;

allowing a slot of the specified output tray to be open, upon successfully matching the second secret information with the first secret information.

31. A non-transitory computer readable storage medium storing thereon an image forming program for an image forming apparatus having a plurality of output trays for stacking sheets on which print data obtained from a terminal via a network is printed that, when executed by a computer, direct the computer to execute a method comprising:

obtaining the print data;

printing the print data on a sheet;

determining, from among the output trays, an output tray for the sheet on which the print data is to be printed by determining a number of sheets to be used to print the print data, and determining an output tray which has a capacity to store the number of sheets to be used to print the print data, to generate output tray identification information;

randomly generating first secret information corresponding to the output tray identification information for identifying the output tray determined;

transmitting the first secret information and the output tray identification information to the terminal;

accepting an input of identification information of a specified output tray from a user;

accepting input of second secret information from the user, when an output of printed sheets to the specified output tray is complete;

matching the second secret information with the first secret information; and allowing a slot of the specified output tray to be open, upon successfully matching the second secret information with the first secret information.

32. The non-transitory computer readable storage medium according to claim 31, wherein the transmitting transmits the first secret information upon the printing completing a printing process of the print data.

33. The non-transitory computer readable storage medium according to claim 32, wherein the transmitting transmits the first secret information and information indicating that an output is completed upon the printing completing a printing process of the print data.

34. The non-transitory computer readable storage medium according to claim 31, wherein the transmitting transmits the first secret information upon the determining generating the output tray identification information.

35. The non-transitory computer readable storage medium according to claim 31, wherein the first secret information corresponds to print data identification information for identifying the print data.

36. The non-transitory computer readable storage medium according to claim 31, the method further comprising assigning job identification information for identifying a print process to the print data obtained, wherein the first secret information corresponds to the job identification information.

37. The non-transitory computer readable storage medium according to claim 31, the method further comprising storing a relational table for associating the output tray identification information with the first secret information, wherein the allowing allows the slot of the specified output tray to be open according to the first secret information and the relational table.

38. The non-transitory computer readable storage medium according to claim 31, the method further comprising detecting, for each of the output trays, whether a sheet is stacked on an output tray of the output trays, wherein the determining determines an output tray detected not to have a stacked sheet as the output tray for the print data.

39. The non-transitory computer readable storage medium according to claim 31, wherein the determining determines an output tray other than an output tray previously determined in a process wait state as the output tray for the print data.

40. The non-transitory computer readable storage medium according to claim 31, the method further comprising calculating a number of print sheets required for printing the print data, wherein the determining determines the output tray based on the number of print sheets and a maximum number of sheets available in each of the output trays.

41. The non-transitory computer readable storage medium according to claim 40, wherein when the number of print sheets exceeds the maximum number of sheets available, the determining determines more than one output tray for the print data, and the generating generates the first secret information corresponding to tray identification information of the more than one output tray.

42. The non-transitory computer readable storage medium according to claim 31, the method further comprising monitoring the printing process of the printing unit, wherein the transmitting transmits the first secret information upon the monitoring detecting an error.

43. A non-transitory computer readable storage medium storing thereon an image forming program for an image forming system including an image forming apparatus having a plurality of output trays for stacking sheets on which print data is printed and a terminal that transmits the print data to the image forming apparatus that, when executed by a computer, direct the computer to execute a method comprising:

steps in the image forming apparatus including obtaining the print data, printing the print data on a sheet, determining, from among the output trays, an output tray for the sheet on which the print data is to be printed by determining a number of sheets to be used to print the print data, and determining an output tray which has a capacity to store the number of sheets to be used to print the print data, to generate output tray identification information, and transmitting the output tray identification information to the terminal, and steps in the terminal including receiving the output tray identification information from the image forming apparatus, randomly generating first secret information corresponding to the output tray identification information, and transmitting the first secret information to the image forming apparatus, and steps in the image forming apparatus further including receiving the first secret information from the terminal, accepting an input of identification information of a specified output tray from a user, accepting input of second secret information from a user, when an output of printed sheets to the specified output tray is complete, matching the second secret information with the first secret information, and allowing a slot of the specified output tray to be open, upon successfully matching the second secret information with the first secret information.

44. The non-transitory computer readable storage medium according to claim 43, wherein the system includes a plurality of the terminals, steps in each of the terminals include holding terminal identification information for identifying the terminal, and the randomly generating generates the first secret information including the terminal identification information.

45. A non-transitory computer readable storage medium storing thereon an image forming program for an image forming apparatus having a plurality of output trays for stacking sheets on which print data obtained from a terminal via a network is printed that, when executed by a computer, direct the computer to execute a method comprising:

obtaining the print data;

printing the print data on a sheet;

determining, from among the output trays, an output tray for the sheet on which the print data is to be printed by determining a number of sheets to be used to print the print data, and determining an output tray which has a capacity to store the number of sheets to be used to print the print data, to generate output tray identification information;

transmitting the output tray identification information;

receiving first secret information generated by the terminal as a response to the tray identification information transmitted, the first secret information being randomly generated and corresponding to the tray identification information;

accepting an input of identification information of a specified output tray from a user;

accepting input of second secret information from a user, when an output of printed sheets to the specified output tray is complete;

matching the second secret information with the first secret information;

allowing a slot of the specified output tray to be open, upon successfully matching the second secret information with the first secret information.

* * * * *